US007711608B2

(12) United States Patent
Asami

(10) Patent No.: US 7,711,608 B2
(45) Date of Patent: May 4, 2010

(54) AUCTION SYSTEM

(75) Inventor: Naoya Asami, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 324 days.

(21) Appl. No.: 11/447,875

(22) Filed: Jun. 7, 2006

(65) Prior Publication Data

US 2007/0168258 A1 Jul. 19, 2007

(30) Foreign Application Priority Data

Jan. 13, 2006 (JP) ..... 2006-005505

(51) Int. Cl.
*G06Q 30/00* (2006.01)

(52) U.S. Cl. ..... 705/26

(58) Field of Classification Search ..... 705/26, 705/27, 37

See application file for complete search history.

(56) References Cited

U.S. PATENT DOCUMENTS

2004/0138986 A1* 7/2004 Petrovich ..... 705/37
2004/0193489 A1* 9/2004 Boyd et al. ..... 705/14
2005/0139674 A1* 6/2005 Ishibashi et al. ..... 235/454

FOREIGN PATENT DOCUMENTS

JP 2005-122629 A 5/2005
JP 2005-149356 A 6/2005

* cited by examiner

*Primary Examiner*—Mila Airapetian
(74) *Attorney, Agent, or Firm*—Westerman, Hattori, Daniels & Adrian, LLP

(57) ABSTRACT

An auction system for use in auctions is provided. In the auction system, a recording medium is attached to an auction item. An auction participant reads information about the auction item out of the recording medium using a mobile data device. In order to place a bid on the auction item, the auction participant writes a bid price to the recording medium using the mobile data device.

11 Claims, 23 Drawing Sheets

AUCTION SYSTEM

BACKGROUND OF THE INVENTION

1. Field of the Invention

The present invention relates to an auction system. In particular, the present invention relates to an auction system in which a recording medium is attached to each auction item and auction participants can bid in an auction using mobile data devices.

2. Description of the Related Art

Auctions in which an auction clerk allows a plurality of auction participants to submit a bid price for an auction item and sells the item to the highest bidder are popular. Furthermore, internet auctions have been developed in which an auction participant browses or searches for an auction item over the Internet. If the auction participant finds the desired item, the auction participant can place a bid on the item by setting a bid price and carrying out a predetermined operation.

A variety of technologies that increase the productivity of an auction have been proposed.

For example, Japanese Unexamined Patent Application Publication No. 2005-122629 describes a winning bid information storage system in which information about an auction item can be stored in a database immediately after an auction participant has won the auction item so as to increase the operating efficiency of the auction.

In addition, Japanese Unexamined Patent Application Publication No. 2005-228231 describes technology in which an auction participant can place bids on a plurality of auction items and, when the winner of a bid on one item is determined, the auction participant can set appropriate bid prices for the other auction items without the need for monitoring the bid status of the plurality of auction items.

However, in known internet auction systems, auction participants cannot view actual auction items, but can only view images of the auction items. Thus, some auction participants are reluctant to buy the auction items. Additionally, the above-described winning bid information storage system does not describe technology for executing an auction while managing intermediate steps of the bid (i.e., the bidding status), although information about a successful bid item of an auction can be immediately stored in a database.

SUMMARY OF THE INVENTION

Accordingly, it is an object of the present invention to provide an auction system using an IC tag for allowing auction participants to directly view an auction item and execute the auction only with participation of the auction members without spending unnecessary time and effort.

According to one embodiment of the present invention, an auction system for determining a bid price for an auction item includes a recording medium for storing item information about the auction item, the recording medium being attached to the auction item, and a data device including readout means for reading out the item information and bidding means for inputting a bid price of the auction item. In this auction system, an auction participant can receive information about auction items and place a bid on the item using the data device. Since an information management server manages item information about the auction items, the auction system can execute the auction only with participation of the auction members without spending unnecessary time and effort.

According to another embodiment of the present invention, an auction system for determining a bid price for an auction item includes a recording medium for storing item information about the auction item, the recording medium being attached to the auction item, a mobile data device including readout means for reading out the item information and bidding means for inputting a bid price of the auction item, and an information management apparatus including storing means and winner determining means. The storing means stores the current highest bid price sent from the mobile data device, information for identifying a bidder who placed the highest bid price, information for identifying the auction item having the highest bid price, and information about a condition for closing the auction on the auction item. The winner determining means determines a winning bidder for the auction item on the basis of the highest bid price when the condition for closing the auction on the auction item is satisfied. In this auction system, an auction participant can receive information about auction items and place a bid on the item using the mobile data device. Since an information management server manages item information about the auction items, the auction system can execute the auction only with participation of the auction members without spending unnecessary time and effort.

According to yet another embodiment of the present invention, an auction system for determining a bid price for an auction item includes a recording medium for storing item information about the auction item, the recording medium being attached to the auction item, a mobile data device including first readout means for reading out the item information and writing means for writing a bid price of the auction item to the recording medium, and an information management apparatus including second readout means, storing means, and winner determining means. The second readout means reads out the item information. The storing means stores the current highest bid price read out by the second readout means, information for identifying a bidder who placed the highest bid price, and information for identifying an auction item having the highest bid price. The winner determining means determines a winning bidder for the auction item on the basis of the highest bid price when an ending time of the auction on the auction item has been reached. In this auction system, an auction participant can read information about the auction item from the recording medium and write new item information to the recording medium using the mobile data device. Since an information management server manages item information about the auction items, the auction system can execute the auction only with participation of the auction members without spending unnecessary time and effort.

According to yet another embodiment of the present invention, an auction system for determining a bid price for an auction item includes a recording medium for storing item information about the auction item, the recording medium being attached to the auction item, a mobile data device including readout means for reading out the item information and bidding means for inputting a bid price of the auction item, and an information management apparatus connected to the mobile data device via a network and including storing means and winner determining means. The storing means stores the current highest bid price sent from the mobile data device, information for identifying a bidder who placed the highest bid price, and information for identifying an auction item having the highest bid price. The winner determining means determines a winning bidder for the auction item on the basis of the highest bid price when an ending time of the auction on the auction item has been reached. In this auction system, an auction participant can read information about the auction item from the recording medium and register new item information to an information management server using the mobile data device. Since the information management server manages the item information about the auction items, the auction system can execute the auction only with participation of the auction members without spending unnecessary time and effort.

The auction system can further include a notification unit. Here, the information about a condition for closing the auction on the auction item is information about an ending time of the auction on the auction item. The notification unit notifies the bidder who placed the highest bid price of information that the bidder has won the auction item when an ending time of the auction on the auction item has been reached. According to this auction system, a bidder who placed the highest bid price can confirm that the bidder has won the auction item when the auction ends.

The auction system can further include a notification unit. Here, the information about a condition for closing the auction on the auction item is information about a bid price. The notification unit notifies a bidder who placed a bid price equal to a price that a seller of the auction item desires of information that the bidder has won the auction item. According to this auction system, a bidder who placed the highest bid price can confirm that the bidder has won the auction item when the auction ends.

The auction system can further include bid ending time monitoring means. Here, the information about a condition for closing the auction on the auction item is information about an ending time of the auction on the auction item, and the bid ending time monitoring means notifies information management apparatus that the ending time of the auction has been reached. According to this auction system, an auction system in which an auction ending time is notified by the bid ending time monitoring means can be provided.

In the auction system, the information about a condition for closing the auction on the auction item may be information about an ending time of the auction on the auction item, and the ending time of the auction may be notified by a third party. According to this auction system, an auction system in which an auction ending time is notified by a third party can be provided.

In the auction system, the recording medium may include an IC tag. According to this auction system, an auction participant can read the item information from the IC tag and write new item information to the IC tag within the service area of the IC tag using the mobile data device.

In the auction system, the recording medium may include a two-dimensional code. According to this auction system, an auction participant can read the item information from the two-dimensional code using the mobile data device.

In the auction system, the mobile data device may include a mobile RFID reader/writer. According to this auction system, an auction participant can read the item information from the IC tag and write new item information to the IC tag within the service area of the IC tag using the mobile RFID reader/writer.

In the auction system, the mobile data device may include a cell phone. According to this auction system, an auction participant can bid in the auction using the cell phone within the service area of the cell phone.

As described above, in the auction system, a recording medium is attached to an auction item. An auction participant reads item information from the recording medium. If the auction participant desires to bid on the auction item, the auction participant writes a bid price to the recording medium. Thus, the auction participant can directly view the auction item and bid on the auction item without spending unnecessary time and effort.

DESCRIPTION OF THE PREFERRED EMBODIMENTS

Embodiments of the present invention are now herein described with reference to the accompanying drawings.

However, it should be appreciated that the present invention is not limited to the following embodiments.

First Exemplary Embodiment

According to a first exemplary embodiment, an IC tag is attached to an auction item as a recording medium.

Figure 1:
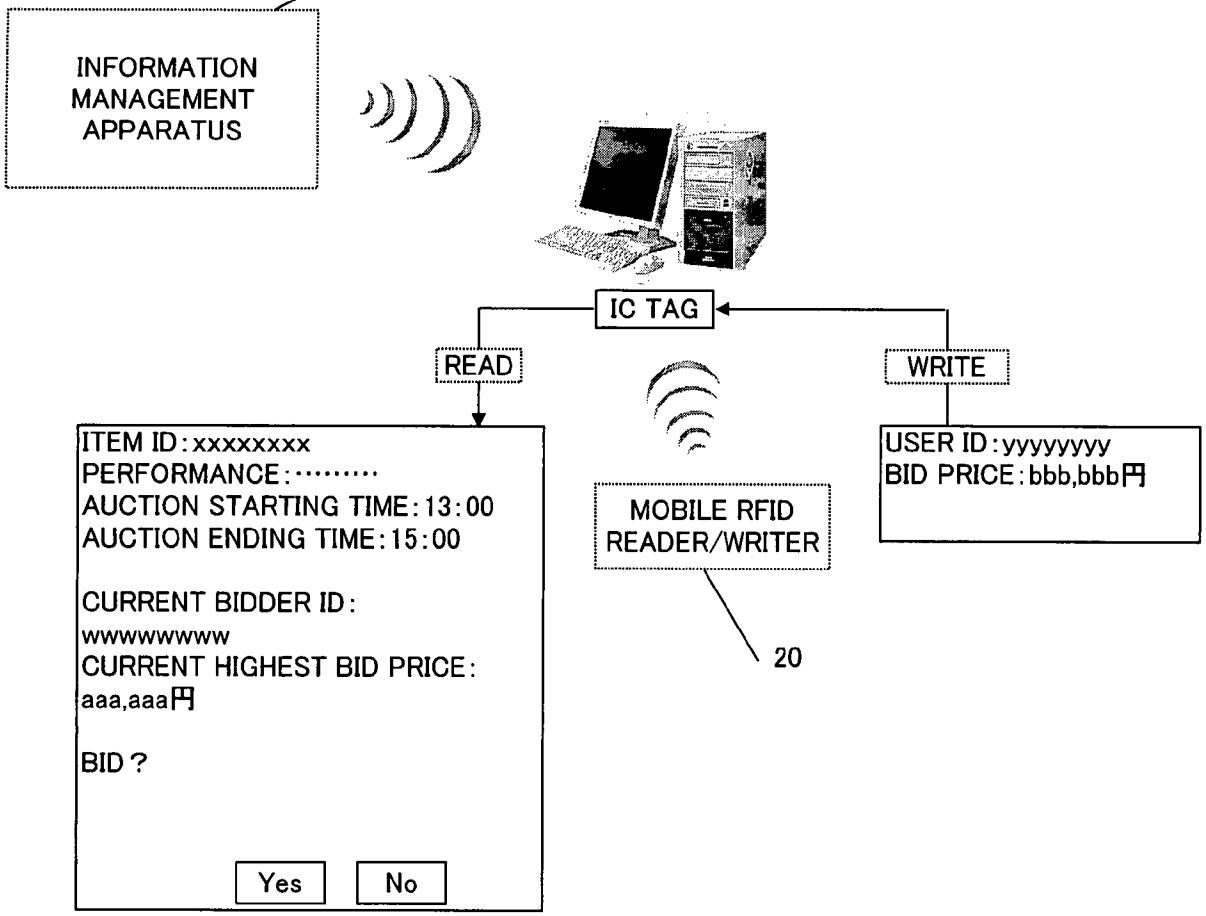
FIG. 1 is a schematic illustration of an auction system according to a first embodiment of the present invention.

FIG. 1 is a schematic illustration of an auction system according to the first embodiment. As shown in FIG. 1, in an auction system, an IC tag is attached to an auction item. The IC tag stores information, such as an item identification (ID), the performance of the item, an auction starting time, and an auction ending time. Each of auction participants has a mobile radio frequency identification (RFID) reader/writer 20 that can read and write the item information from and to an IC tag attached to the auction item. Additionally, an information management apparatus 10 periodically updates the item information of the auction item.

Figure 4:
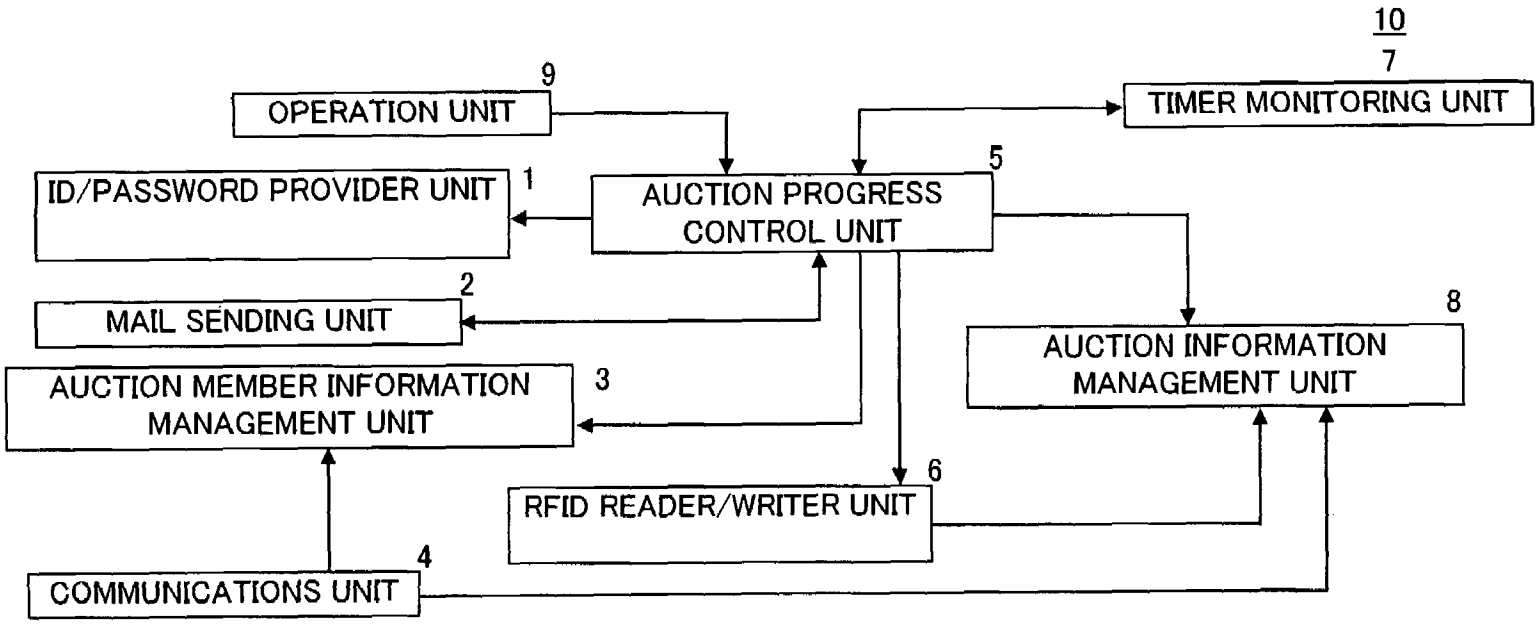
FIG. 4 is a schematic block diagram of an exemplary hardware configuration of an information management server according to the first embodiment of the present invention.

FIG. 4 is a block diagram of an exemplary configuration of the information management apparatus 10. The information management apparatus 10 includes an auction member information management unit 3, an ID/password provider unit 1, an RFID reader/writer unit 6, an auction information management unit 8, a timer monitoring unit 7, a mail sending unit 2, and an auction progress control unit 5 to which all of the above-described units are connected. The auction member information management unit 3 stores contact information and payment information about auction participants. The ID/password provider unit 1 provides an auction participant with an ID and password in response to the operation of an operation unit 9 by the auction participant. The RFID reader/writer unit 6 reads or writes item information (e.g., an item ID, the performance of an item, an auction starting time, an auction ending time, and the current highest bid) from or to the IC tag attached to the auction item. The auction information management unit 8 stores the item information read by the RFID reader/writer unit 6. The timer monitoring unit 7 periodically sends notification for the auction progress control unit 5 to read the information on an IC tag attached to an auction item. The mail sending unit 2 sends the highest winning bidder an email indicating that the item has been won. The auction progress control unit 5 controls all the units of the information management apparatus 10. Also, the auction progress control unit 5 selects the winning bidder when an auction closing condition is satisfied. Furthermore, a communications unit 4 is connected to the auction member information management unit 3 and the auction information management unit 8. The communications unit 4 receives an inquiry as to auction information from the mobile RFID reader/writer 20, which is described below.

The process in which an auction participant inputs the contact information and the information management apparatus 10 issues an ID and password to the auction participant is described next.

Figure 7:
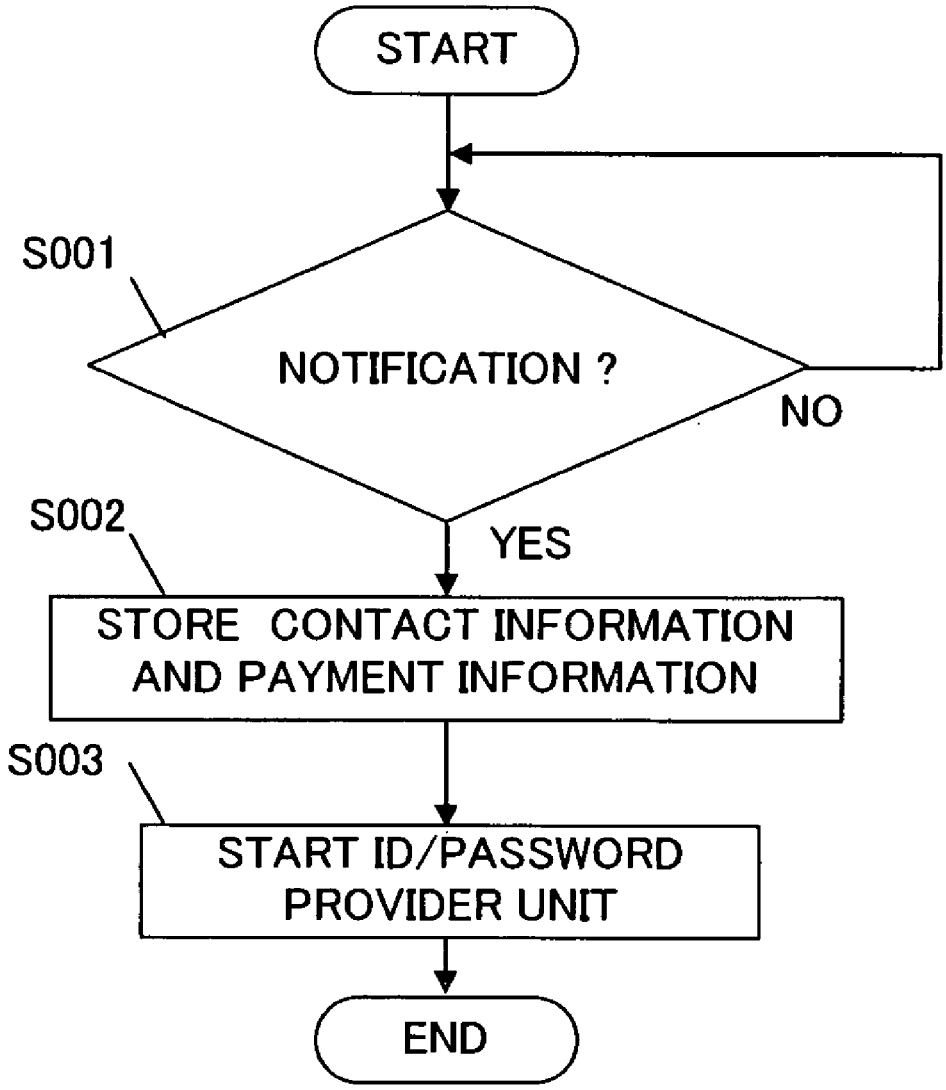
FIG. 7 is a flow chart of the operation of an auction progress control unit.

First, the process of the auction progress control unit 5 by which member information is received is described next with reference to FIG. 7.

At step S001, the auction progress control unit 5 determines whether it has received, from the operation unit 9, a notification that an auction participant has input the user contact information and payment information. The user contact information comprises an email address of the auction participant. If the auction participant wins the auction item, a notification of that information is sent to that email address. The payment information indicates how the auction participant intends to make a payment for the item that the auction participant won a bid on. For example, the auction participant enters the bank account details thereof. The purchase amount is transferred from that bank account so that the auction participant can immediately purchase the item. If the determination is affirmative (i.e., the notification of the input of contact information and payment information is present), the processing proceeds to step S002. However, if the determination is negative, the processing returns to step S001.

At step S002, the auction progress control unit 5 stores the contact information and payment information input to the auction member information management unit 3. Thereafter, the processing proceeds to step S003.

At step S003, the auction progress control unit 5 starts the ID/password provider unit 1 so as to provide the auction participant with an ID and password. The ID and password are necessary for the auction participant to bid in an auction using the mobile RFID reader/writer 20. If the information management apparatus 10 authenticates the auction participant, the auction participant can write item information into an IC tag using the mobile RFID reader/writer 20. The authentication process can prevent third parties from spoofing the auction participant and setting a bid price. Thereafter, the processing is completed.

Figure 8:
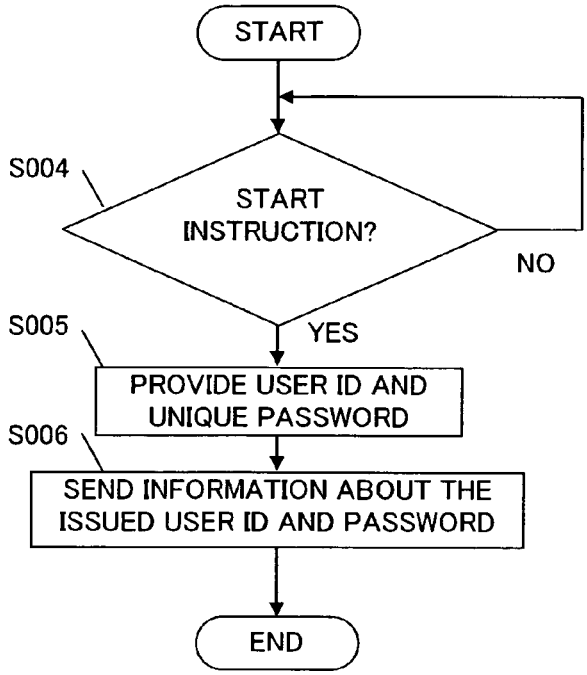
FIG. 8 is a flow chart of the operation of an ID/password provider unit.

The process of the ID/password provider unit 1 performed to issue an ID and password is described next with reference to FIG. 8.

At step S004, the ID/password provider unit 1 determines whether it has received a start instruction from the auction progress control unit 5. If the determination is affirmative (i.e., the start instruction is present), the processing proceeds to step S005. However, if the determination is negative, the processing returns to step S004.

At step S005, the ID/password provider unit 1 provides the auction participant with a unique user ID and a unique password.

At step S006, the ID/password provider unit 1 sends information about the issued user ID and password to the auction progress control unit 5. The processing is then completed.

Figure 9:
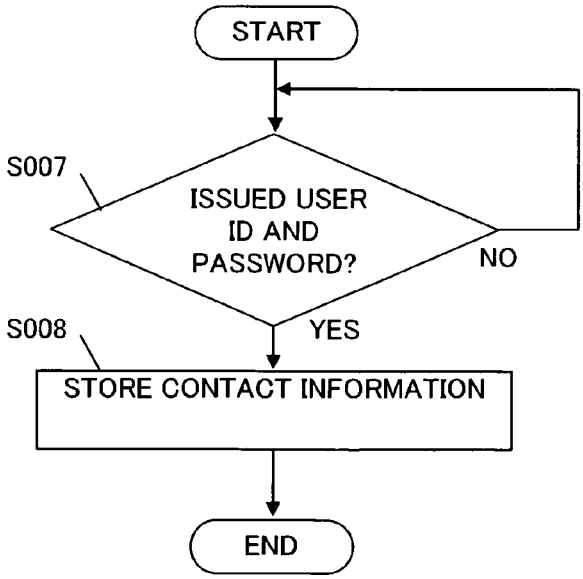
FIG. 9 is a flow chart of the operation of an auction progress control unit.

The process of the auction progress control unit 5 performed to store the contact information about the auction participant is described next with reference to FIG. 9.

At step S007, the auction progress control unit 5 determines whether it has received the issued user ID and password from the ID/password provider unit 1. If the determination is affirmative (i.e., the issued user ID and password are received), the processing proceeds to step S008. However, if the determination is negative, the processing returns to step S007.

At step S008, the auction progress control unit 5 stores the contact information about the auction participant in the auction member information management unit 3 in association with the ID and password. The processing is then completed.

The process of the information management apparatus 10 performed to update the item information about the auction item and notify an auction participant who has won the item of that winning information when it is found that the auction ending time of the item has lapsed is described next.

Figure 10:
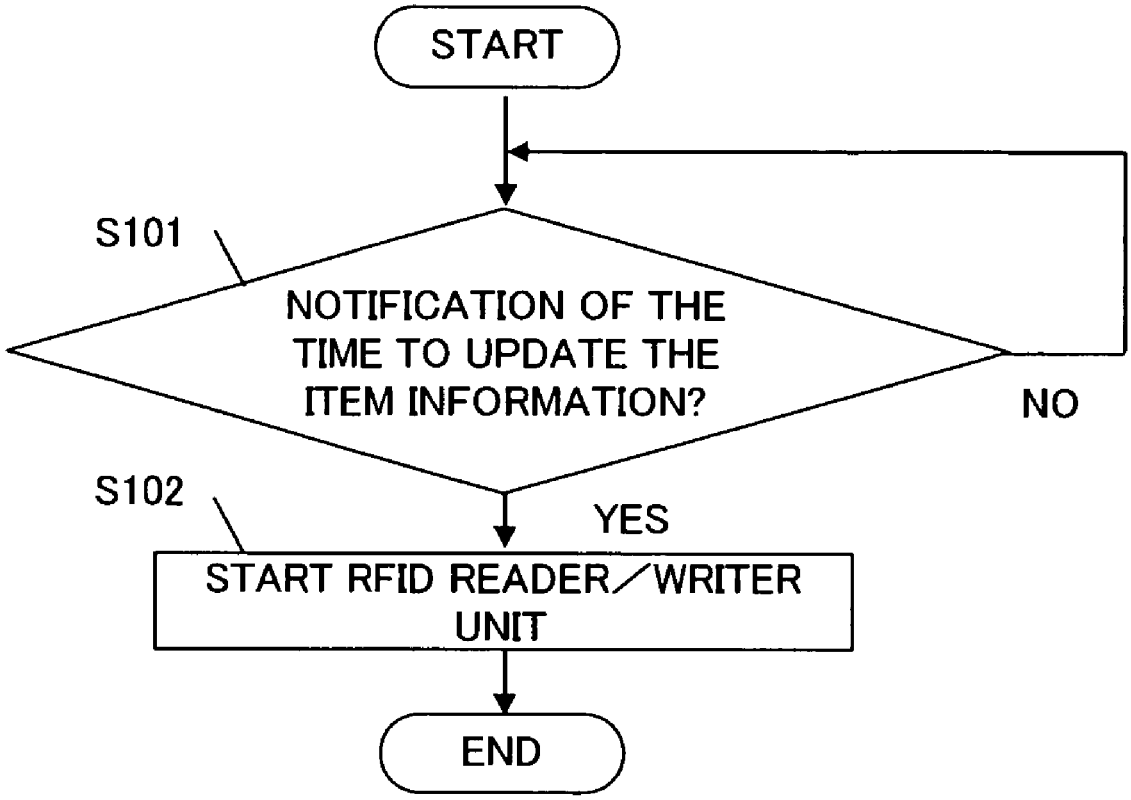
FIG. 10 is a flow chart of the operation of a control unit.

First, the process of the auction progress control unit 5 performed to start an RFID reader/writer unit 6 is described next with reference to FIG. 10.

At step S101, the auction progress control unit 5 determines whether it has received a notification of the time to update the item information from the timer monitoring unit 7. If the determination is affirmative (i.e., the notification of the time to update the item information has been received), the processing proceeds to step S102. However, if the determination is negative, the processing returns to step S101.

At step S102, the auction progress control unit 5 starts the RFID reader/writer unit 6 of the information management apparatus 10. The processing is then completed.

Figure 11:
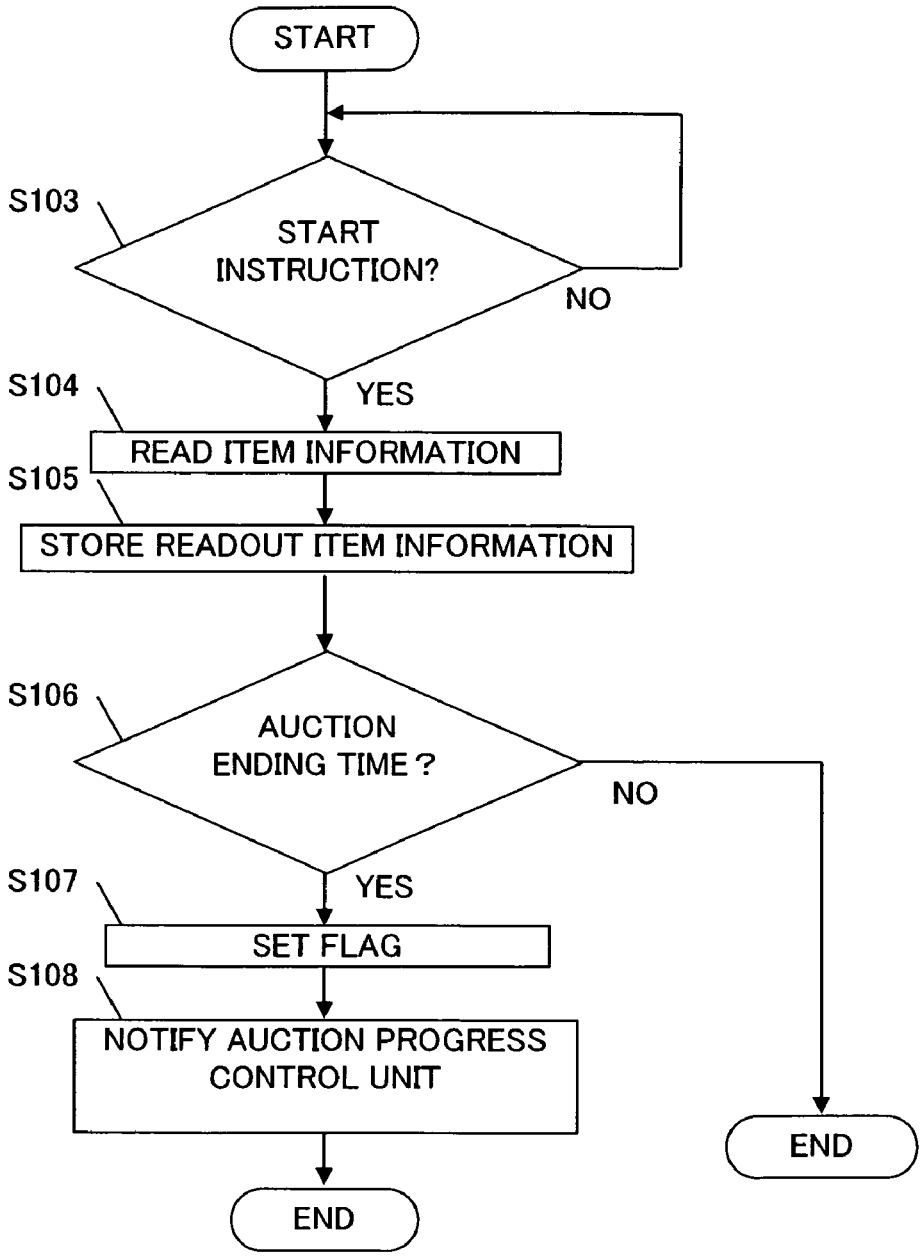
FIG. 11 is a flow chart of the operation of a mobile RFID reader/writer unit.

Subsequently, the process of the RFID reader/writer unit 6 performed to read the item information is described next with reference to FIG. 11.

At step S103, the RFID reader/writer unit 6 determines whether it has received a start instruction from the auction progress control unit 5. If the determination is affirmative (i.e., the start instruction has been received), the processing proceeds to step S104. However, if the determination is negative, the processing returns to step S103.

At step S104, the RFID reader/writer unit 6 reads the item information from an IC tag attached to the auction item. The processing then proceeds to step S105.

At step S105, the RFID reader/writer unit 6 stores the readout item information in the auction information management unit 8. The processing then proceeds to step S106.

At step S106, the RFID reader/writer unit 6 determines whether the auction ending time in the readout item information has lapsed. If the determination is affirmative (i.e., the auction ending time has lapsed), the processing proceeds to step S107. However, if the determination is negative, the processing is completed.

At step S107, the RFID reader/writer unit 6 sets a flag so that an auction participant cannot write information on the IC tag of the item whose auction ending time has lapsed. Thus, an auction participant cannot write a bid price on the IC tag of the item whose auction ending time has lapsed. The processing then proceeds to step S108.

At step S108, the RFID reader/writer unit 6 notifies the auction progress control unit 5 of the item ID of the item whose auction ending time has lapsed and the user ID of the winner of the item. The processing is then completed.

Figure 12:
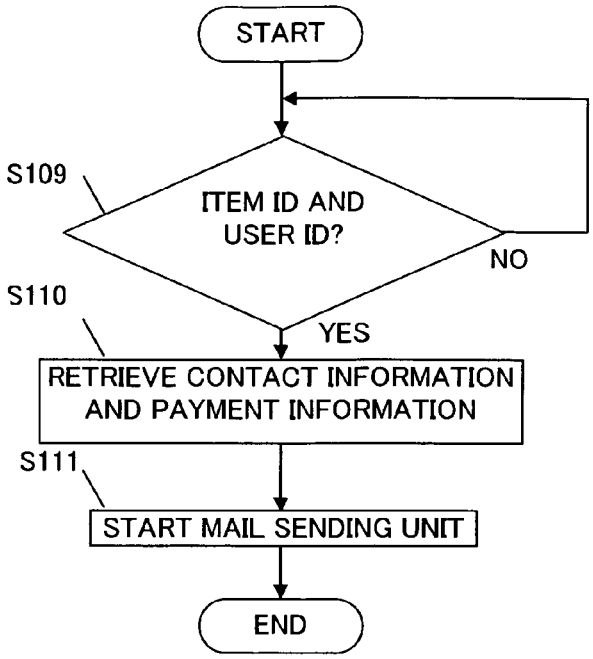
FIG. 12 is a flow chart of the operation of the control unit.

The process of the auction progress control unit 5 performed to start the mail sending unit 2 is described next with reference to FIG. 12.

At step S109, the auction progress control unit 5 determines whether it has received the item ID of the item whose auction ending time has lapsed and the user ID of the winner of the item from the RFID reader/writer unit 6. If the determination is affirmative (i.e., the item ID and user ID has been received), the processing proceeds to step S110. However, if the determination is negative, the processing returns to step S109.

At step S110, the auction progress control unit 5 references the notified user ID and retrieves the contact information and payment information of the auction participant who won the bid on the item from the auction member information management unit 3. The processing then proceeds to step S111.

At step S111, the auction progress control unit 5 starts the mail sending unit 2 and notifies the mail sending unit 2 of the contact information and payment information of the auction participant who won the bid on the item received at step S110. Thereafter, the processing is completed.

Figure 13:
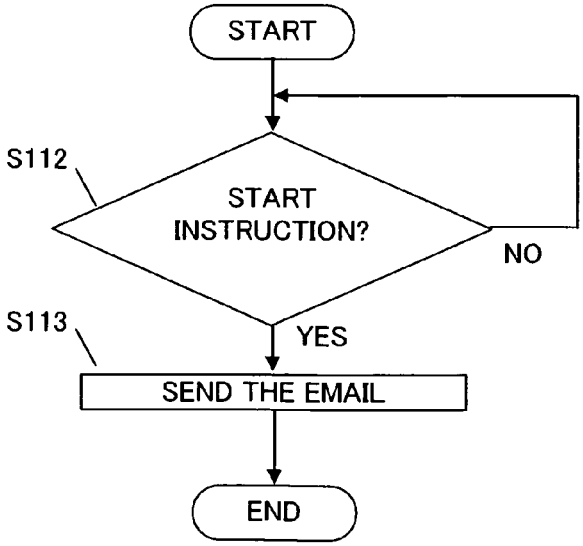
FIG. 13 is a flow chart of the operation of a mail sending unit.
Figure 14:
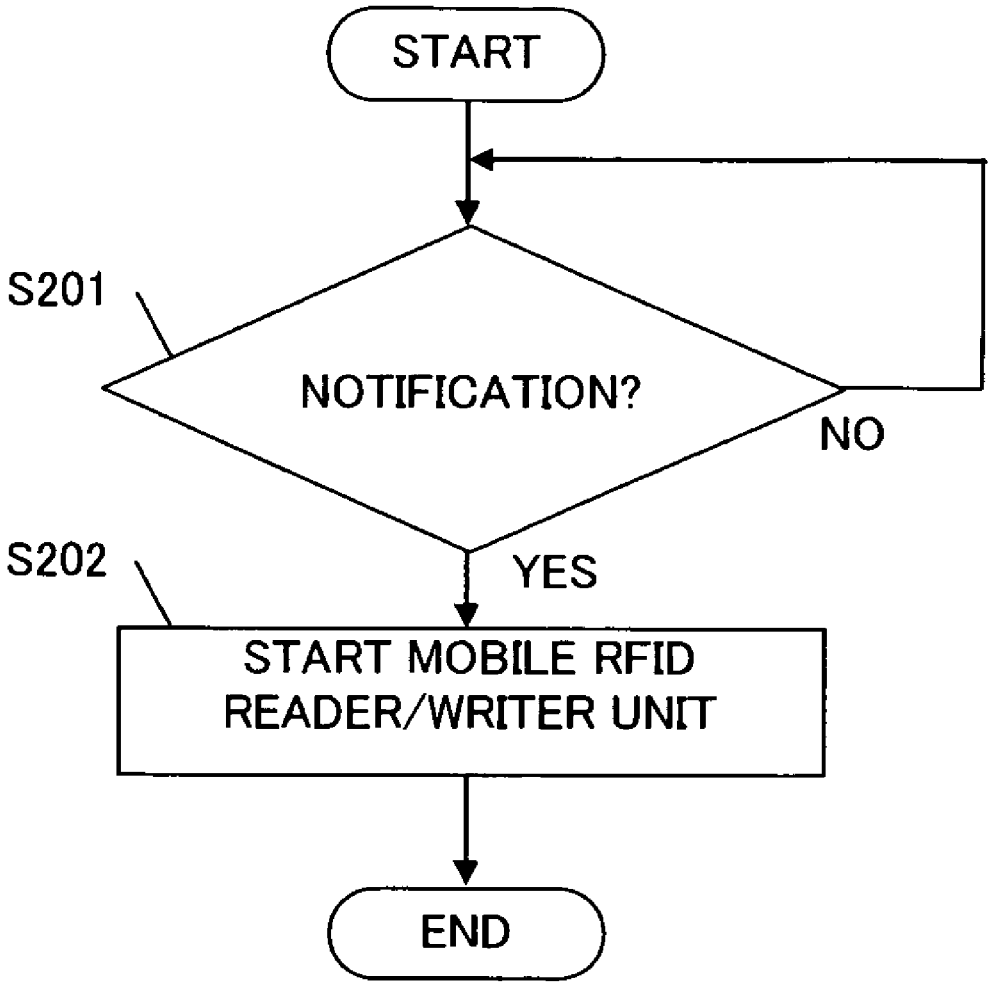
FIG. 14 is a flow chart of the operation of the control unit.

The process of the mail sending unit 2 performed to send an email to the auction participant who won the bid on the item is described next with reference to FIG. 13.

At step S112, the mail sending unit 2 determines whether it has received a start instruction from the auction progress control unit 5. If the determination is affirmative (i.e., the start instruction has been received), the processing proceeds to step S113. However, if the determination is negative, the processing returns to step S112.

At step S113, the mail sending unit 2 sends an email to the address received from the auction progress control unit 5. The email contains the item ID and a purchase price of the item that the auction participant won the bid on. Thus, the auction participant can confirm that the auction participant won the bid on the auction item. Thereafter, the processing is completed.

In this embodiment, the information management apparatus 10 monitors the auction ending time of an auction item. When the auction ending time has lapsed, the auction is completed. However, another configuration can be provided. For example, when an auction participant wants to sell an item at some price, the auction participant sets a desired price for the item. Thereafter, the information management apparatus 10 may monitor bid prices of the item. When another auction participant places a bid on the item at the desired price, the auction may be completed.

The operation of the auction participant performed to read item information in an IC tag attached to an auction item and write a bid price to the IC tag using the mobile RFID reader/writer 20 is described next.

Figure 3:
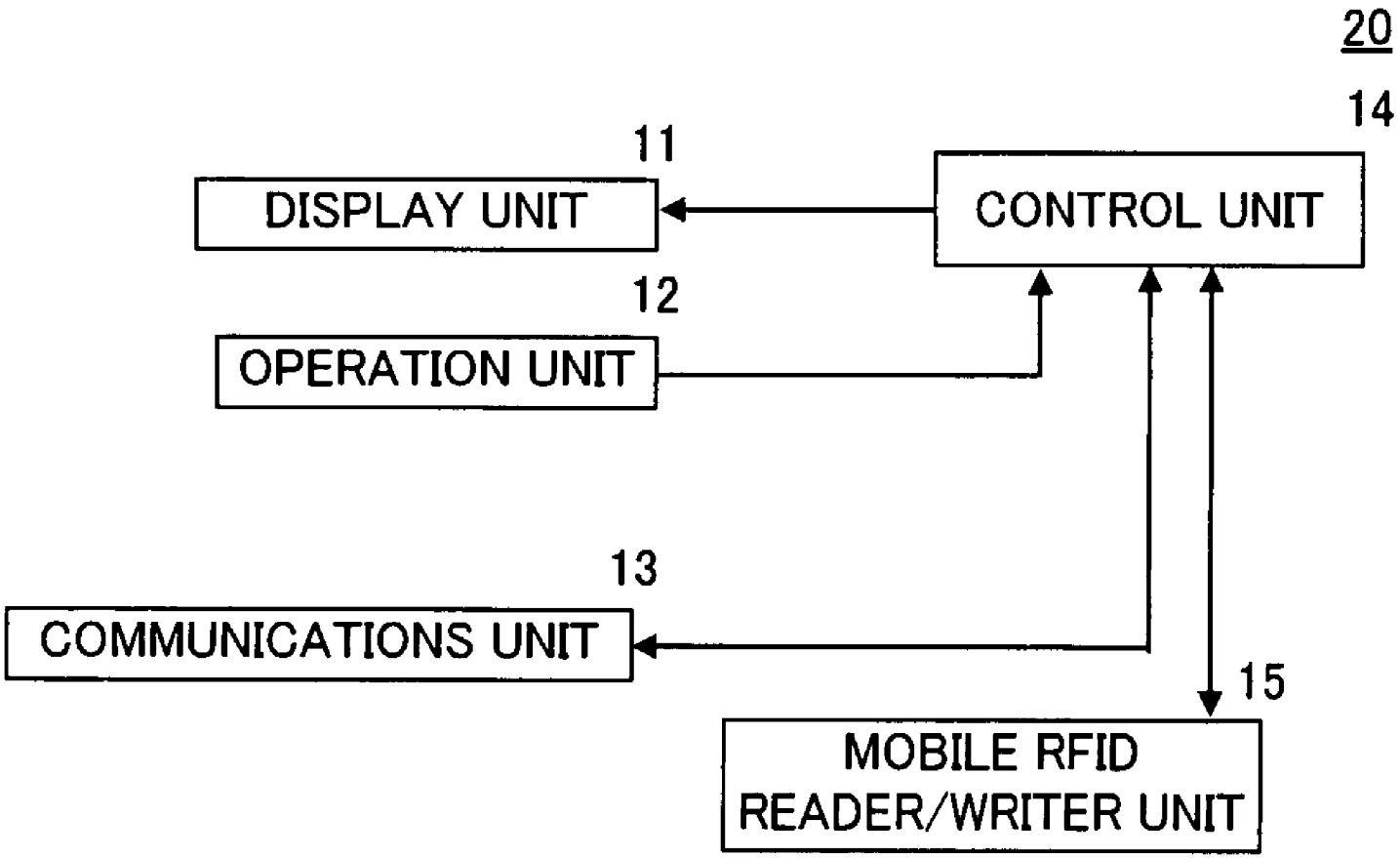
FIG. 3 is a schematic block diagram of an exemplary hardware configuration of a mobile data device according to the first embodiment of the present invention.

FIG. 3 is a block diagram of an exemplary configuration of the mobile RFID reader/writer 20.

The mobile RFID reader/writer 20 includes a mobile RFID reader/writer unit 15 for reading and writing item information from and to an IC tag attached to an auction item, a display unit 11 for displaying the item information, an operation unit 12 used for the reading and writing operation by an auction participant, and a control unit 14 to which all the above-described units are connected. The control unit 14 carries out overall control of the above-described units.

The process of the mobile RFID reader/writer unit 15 is described next with reference to the accompanying drawings.

First, the process of the control unit 14 performed to start the mobile RFID reader/writer unit 15 is described next.

At step S201, the control unit 14 determines whether it has received, from the operation unit 12, a notification that an auction participant has operated the operation unit 12 to instruct reading of the IC tag. In the first embodiment, since an IC tag is attached to an auction item, the mobile RFID reader/writer unit 15 can read out all the item information of auction items located within the service area of the mobile RFID reader/writer unit 15. Thus, the auction participant can read all the item information when, for example, the auction participant wants to compare the performance of the items with each other. Thereafter, by operating the mobile RFID reader/writer 20, the auction participant can select bid items. If the determination is affirmative (i.e., the notification is received), the processing proceeds to step S202. However, if the determination is negative, the processing returns to step S201.

At step S202, the control unit 14 starts the mobile RFID reader/writer unit 15. The processing is then completed.

Figure 15:
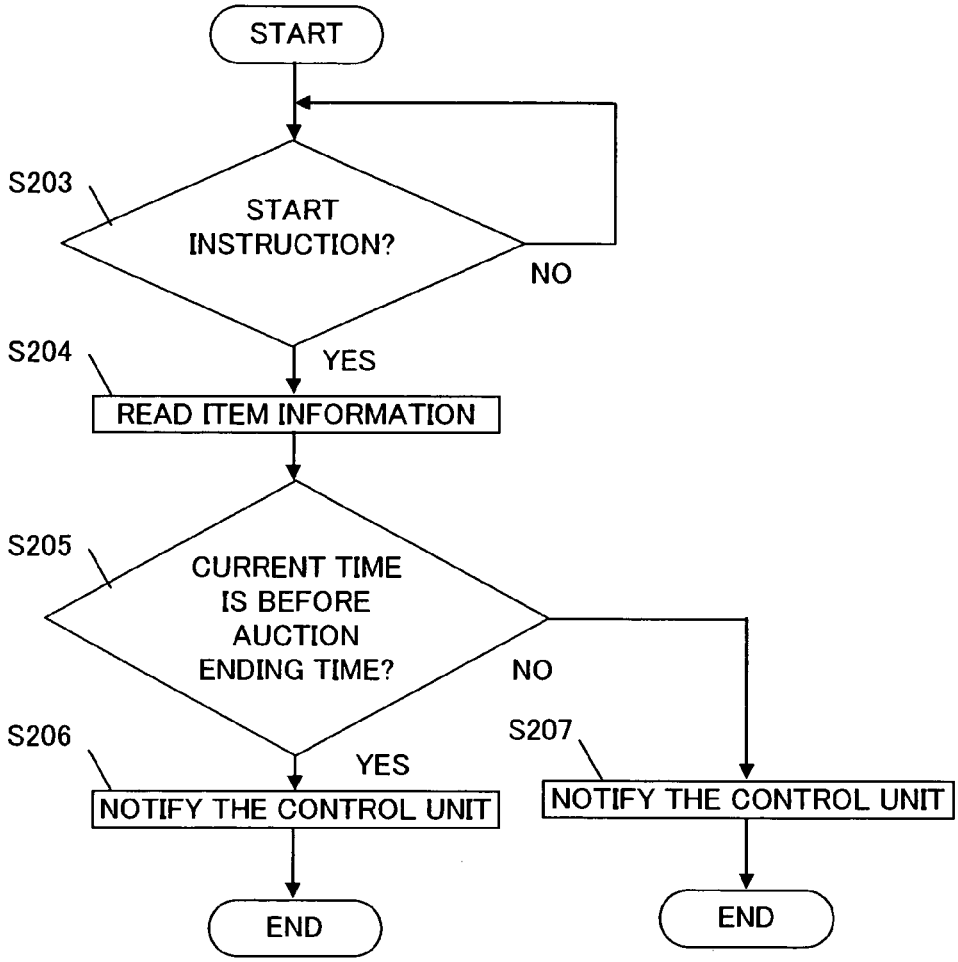
FIG. 15 is a flow chart of the operation of a mobile RFID reader/writer unit.

The process of the mobile RFID reader/writer unit 15 performed to read the IC tag is described next with reference to FIG. 15.

At step S203, the mobile RFID reader/writer unit 15 determines whether it has received a start instruction from the control unit 14. If the determination is affirmative (i.e., the start instruction has been received), the processing proceeds to step S204. However, if the determination is negative, the processing returns to step S203.

At step S204, the mobile RFID reader/writer unit 15 reads item information from the IC tag attached to an auction item. Thereafter, the processing proceeds to step S205.

At step S205, the mobile RFID reader/writer unit 15 determines whether the current time is before the auction ending time of the auction item on the basis of the readout item information in the IC tag. If the determination is affirmative (i.e., the current time is before the auction ending time), the processing proceeds to step S206. However, if the determination is negative, the processing proceeds to step S207.

At step S206, the mobile RFID reader/writer unit 15 notifies the control unit 14 of the completion of reading the IC tag (i.e., the information indicating that the auction ending time has not lapsed yet). The processing is then completed.

At step S207, the mobile RFID reader/writer unit 15 notifies the control unit 14 of the completion of reading the IC tag (i.e., the information indicating that the auction ending time has lapsed). The processing is then completed.

Figure 16:
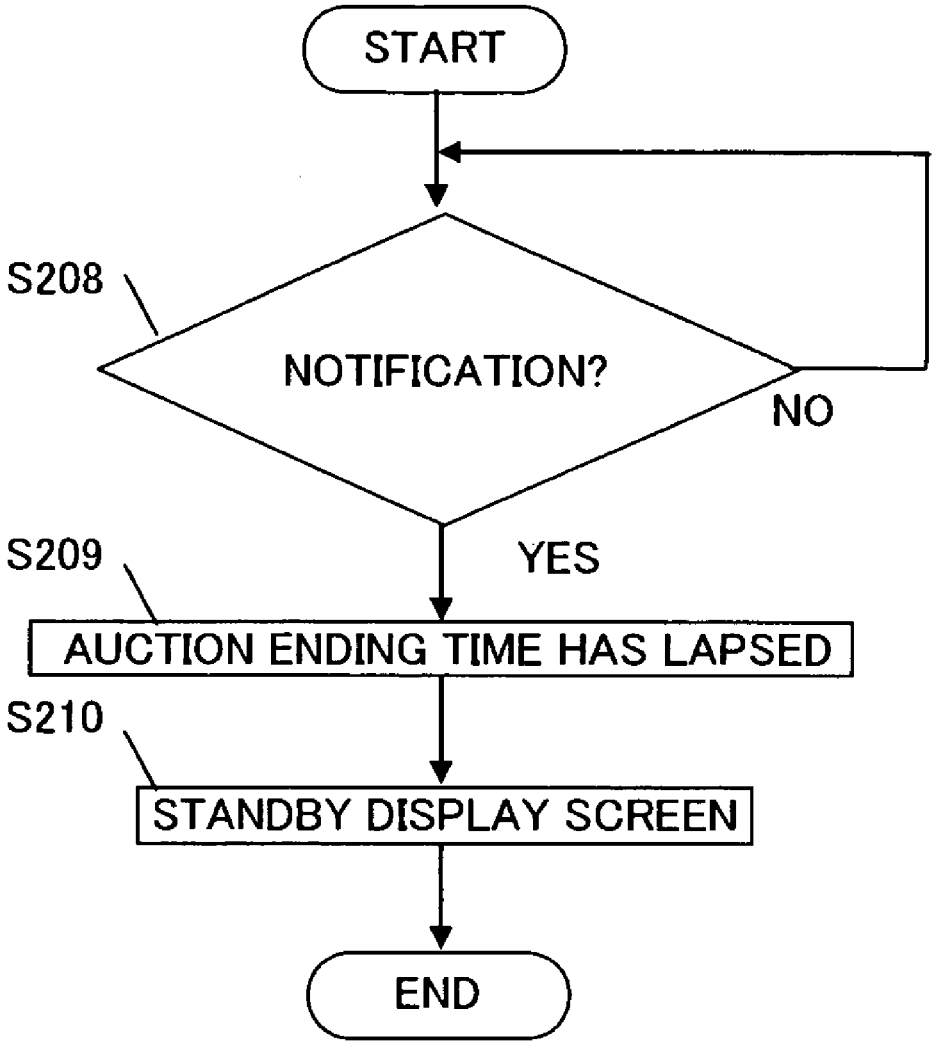
FIG. 16 is a flow chart of the operation of the control unit.

The process of the control unit 14 performed to display the information indicating that the auction ending time has lapsed on the display unit 11 is described next with reference to FIG. 16.

At step S208, the control unit 14 determines whether it has received the notification of the completion of reading the IC tag (the information indicating that the auction ending time has lapsed) from the mobile RFID reader/writer unit 15. If the determination is affirmative (i.e., the notification is present), the processing proceeds to step S209. However, if the determination is negative, the processing returns to step S208.

At step S209, the control unit 14 displays a message "The auction ending time has lapsed. You cannot place a bid." on the display unit 11. Thus, the control unit 14 prompts the auction participant to change the bid item. Thereafter, the processing proceeds to step S210.

At step S210, the control unit 14 displays a standby display screen on the display unit 11. Thereafter, the processing is completed.

Figure 17:
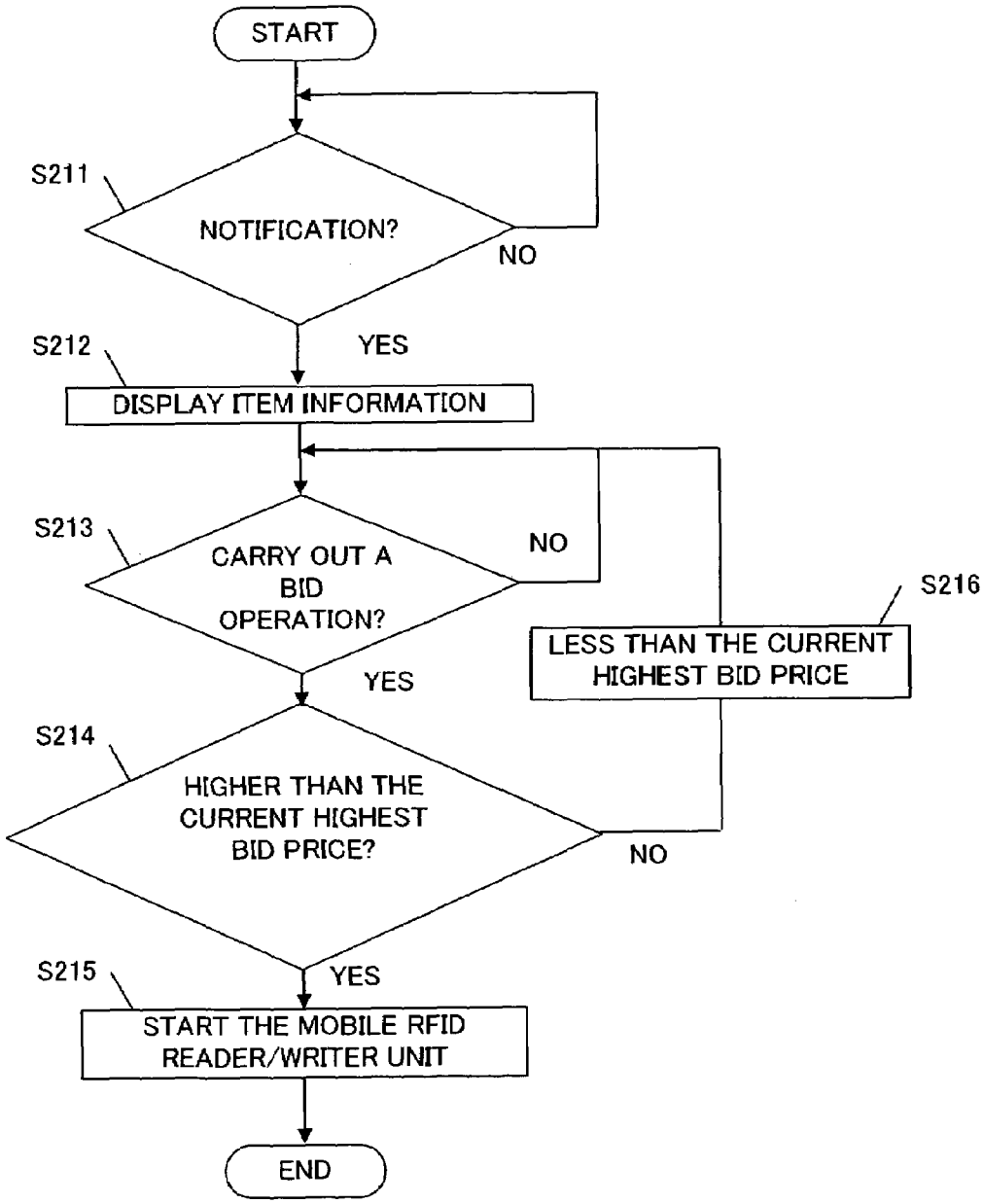
FIG. 17 is a flow chart of the operation of the mobile RFID reader/writer unit.

The process of the control unit 14 performed to display the item information on the display unit 11 is described next with reference to FIG. 17.

At step S211, the control unit 14 determines whether it has received the notification of the completion of reading the IC tag (the information indicating that the auction ending time has not lapsed yet) from the mobile RFID reader/writer unit 15. If the determination is affirmative (i.e., the notification is present), the processing proceeds to step S212. However, if the determination is negative, the processing returns to step S211.

At step S212, the control unit 14 displays the item information on the display unit 11. The auction participant can carry out a bid operation on the basis of the readout item information. Thus, in the first embodiment, since an IC tag is attached to an auction item, an auction participant can immediately check the current highest bid price using the mobile RFID reader/writer 20. Thereafter, the processing proceeds to step S213.

At step S213, the control unit 14 determines whether the auction participant has carried out a bid operation. In the first embodiment, the term "bid operation" refers to an operation in which an auction participant sets a price higher than the current highest bid price and attempts to purchase the auction item. Thus, in the first embodiment, since an IC tag is attached to an auction item, an auction participant can immediately write a bid price to the IC tag using the mobile RFID reader/writer 20. If the determination is affirmative (i.e., the bid operation has been carried out), the processing proceeds to step S214. However, if the determination is negative, the processing returns to step S213.

At step S214, the control unit 14 determines whether the bid price set by the auction participant is higher than the current highest bid price. In auctions, an auction participant cannot win an item unless the auction participant sets a bid price higher than the current highest bid price. Therefore, the determination at step S214 is required. If the determination is affirmative (i.e., the set bid price is higher than the current highest bid price), the processing proceeds to step S215. However, if the determination is negative, the processing proceeds to step S216.

At step S216, the control unit 14 displays a message "You cannot bid because your bid price is less than the current highest bid price." on the display unit 11 so as to prompt the auction participant to change the bid price. Thereafter, the processing returns to step S213.

At step S215, the control unit 14 starts the mobile RFID reader/writer unit 15. Thereafter, the processing is completed.

Figure 18:
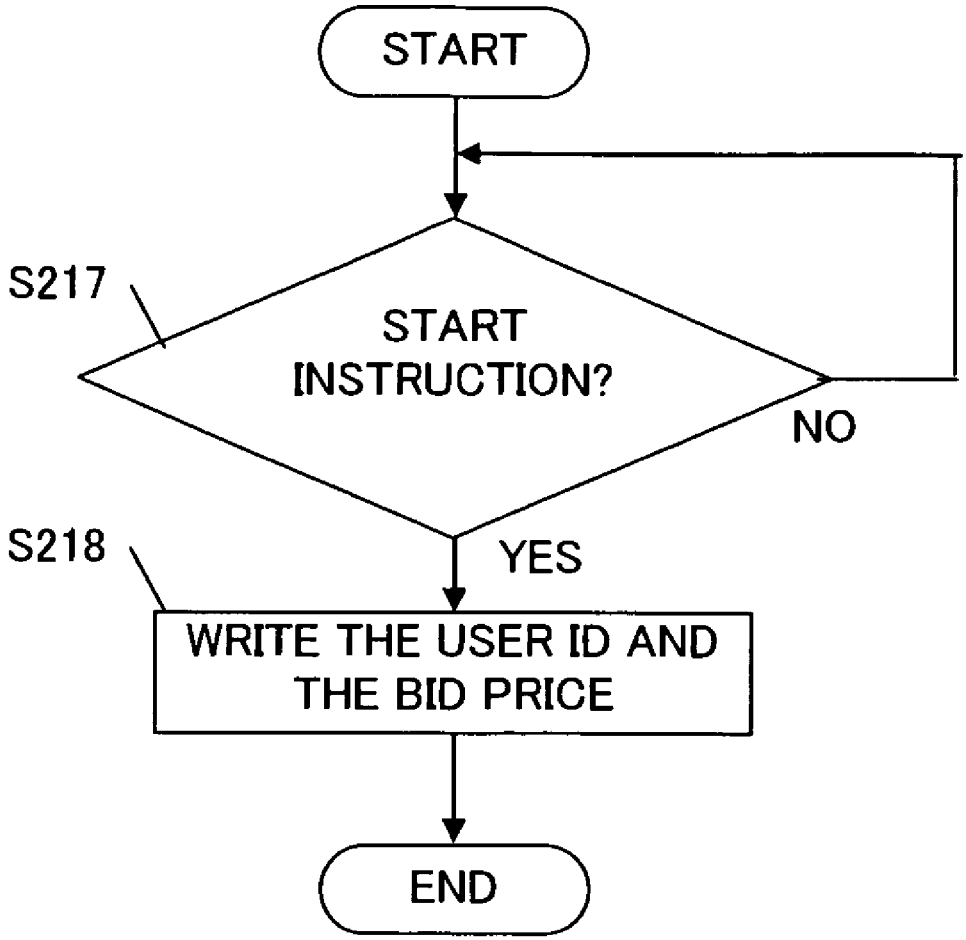
FIG. 18 is a flow chart of the operation of the mobile RFID reader/writer unit.

The process of the mobile RFID reader/writer unit 15 performed to write a bid price to the IC tag is described next with reference to FIG. 18.

At step S217, the mobile RFID reader/writer unit 15 determines whether it has received a start instruction from the control unit 14. If the determination is affirmative (i.e., the start instruction has been received), the processing proceeds to step S218. However, if the determination is negative, the processing returns to step S217.

At step S218, the mobile RFID reader/writer unit 15 writes the user ID and the bid price to the IC tag. Thereafter, the processing is completed.

Second Exemplary Embodiment

According to a second exemplary embodiment, a two-dimensional code is attached to an auction item as a recording medium.

Figure 2:
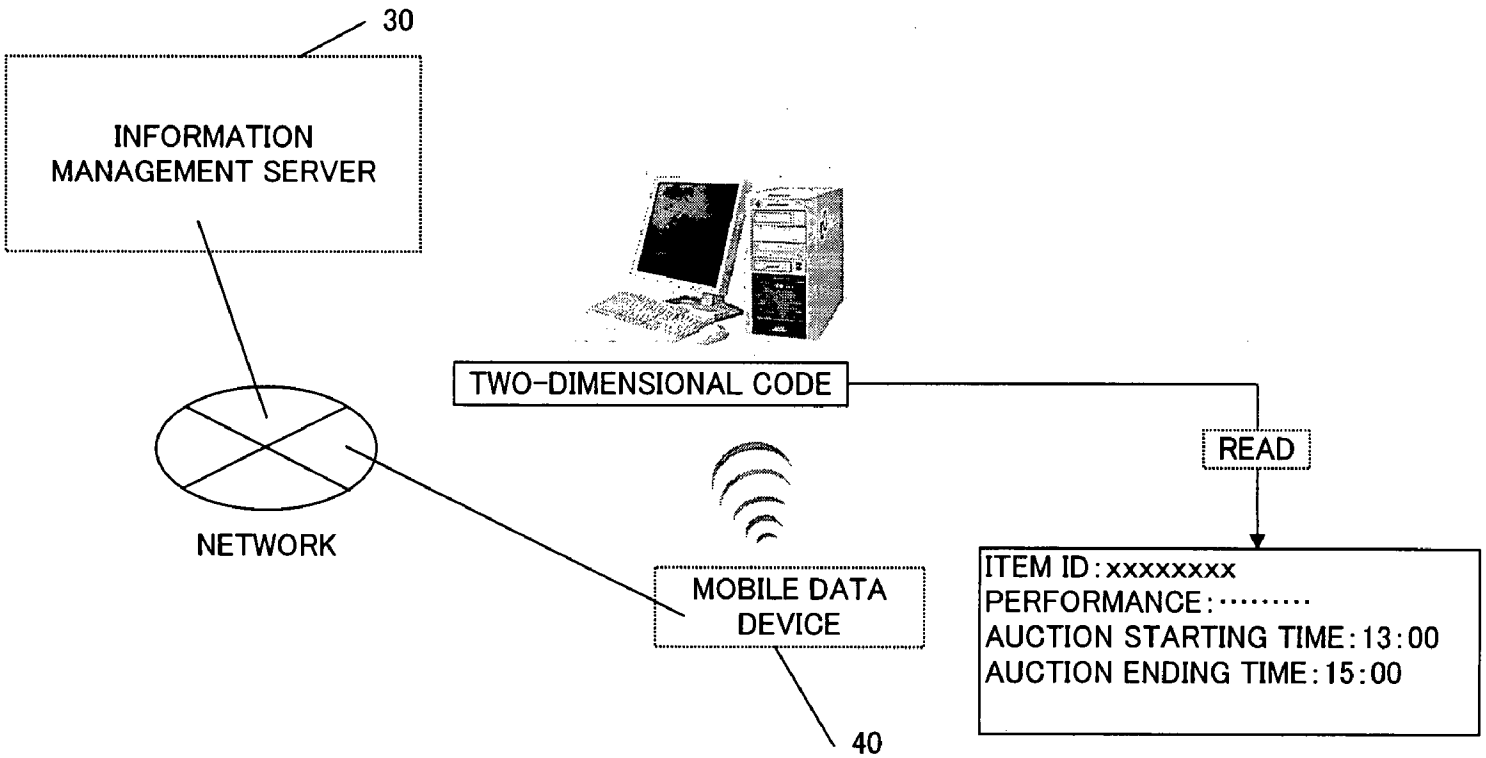
FIG. 2 is a schematic illustration of an auction system according to a second embodiment of the present invention.

FIG. 2 is a schematic illustration of an auction system according to the second embodiment. As shown in FIG. 2, in the auction system, an information management server 30 is connected to a network, such as the Internet. A two-dimensional code is attached to an auction item. The two-dimensional code stores information, such as an auction item ID, the performance of the item, an auction starting time, and an auction ending time. A typical example of the two-dimensional code is a QR code. Each of auction participants has a mobile data device 40 capable of being connected to the information management server 30 via the network. Examples of the mobile data device 40 include a cell phone and a personal digital assistant (PDA).

Figure 5:
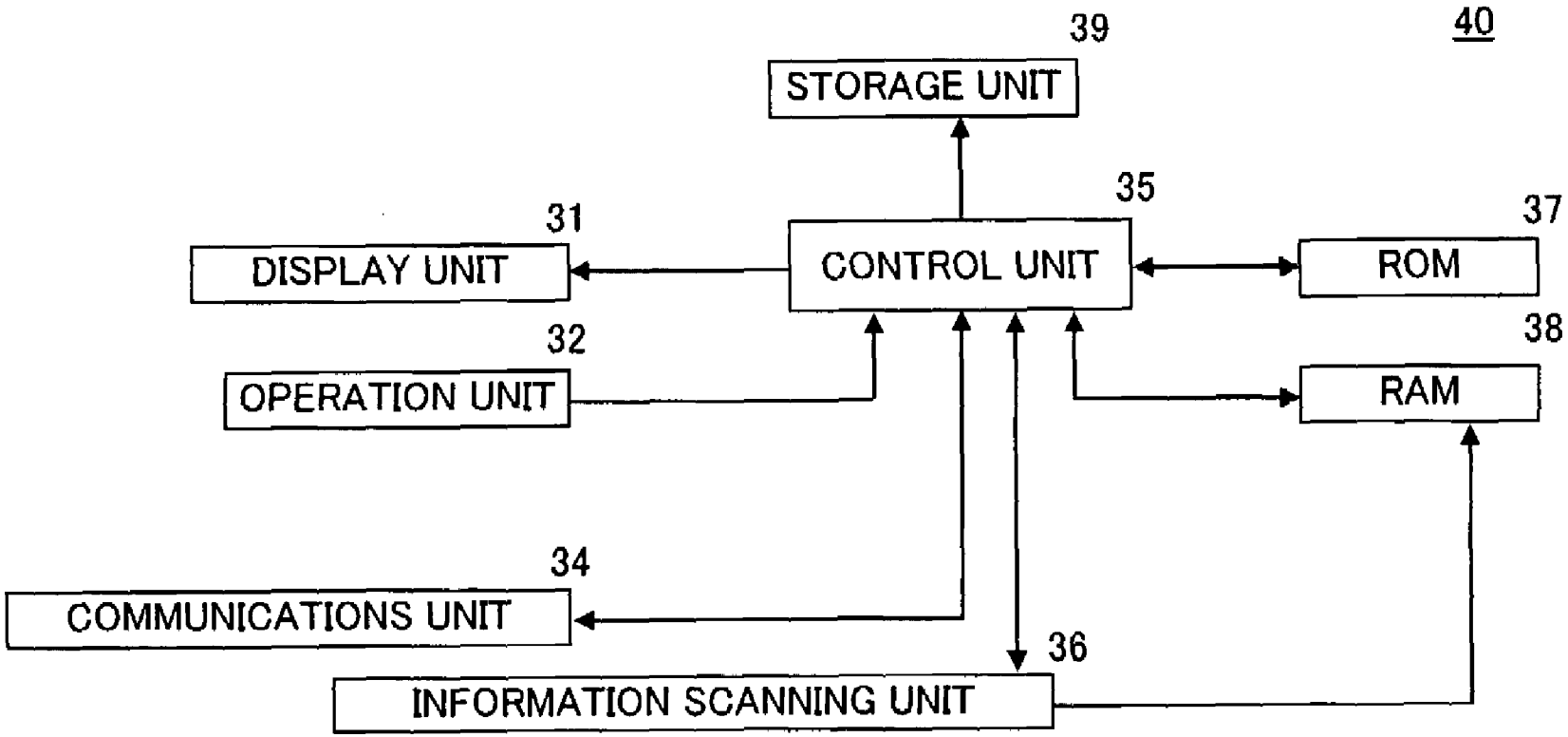
FIG. 5 is a schematic block diagram of an exemplary hardware configuration of a mobile data device according to the second embodiment of the present invention.

FIG. 5 is a block diagram of an exemplary configuration of the mobile data device 40. The mobile data device 40 includes a read only memory (ROM) 37, a random access memory (RAM) 38, a storage unit 39, a communications unit 34, an information scanning unit 36, a display unit 31, an operation unit 32, and a control unit 35 to which all the above-described units are connected. The control unit 35 carries out overall control of the mobile data device 40. The information scanning unit 36 reads out a two-dimensional code attached to an auction item. The display unit 31 displays information contained in the readout two-dimensional code. The operation unit 32 receives a variety of operations by the auction participant. The storage unit 39 stores a program for decoding the two-dimensional code and decoded item information about an auction item. The ROM 37 stores an operating system (OS) of the mobile data device 40 and communications programs. The RAM 38 temporarily stores the program loaded from the storage unit 39 and an image scanned by the information scanning unit 36. Thus, the RAM 38 is used for executing the program and processing the information. The communications unit 34 provides a communication function for communicating with the network.

Figure 6:
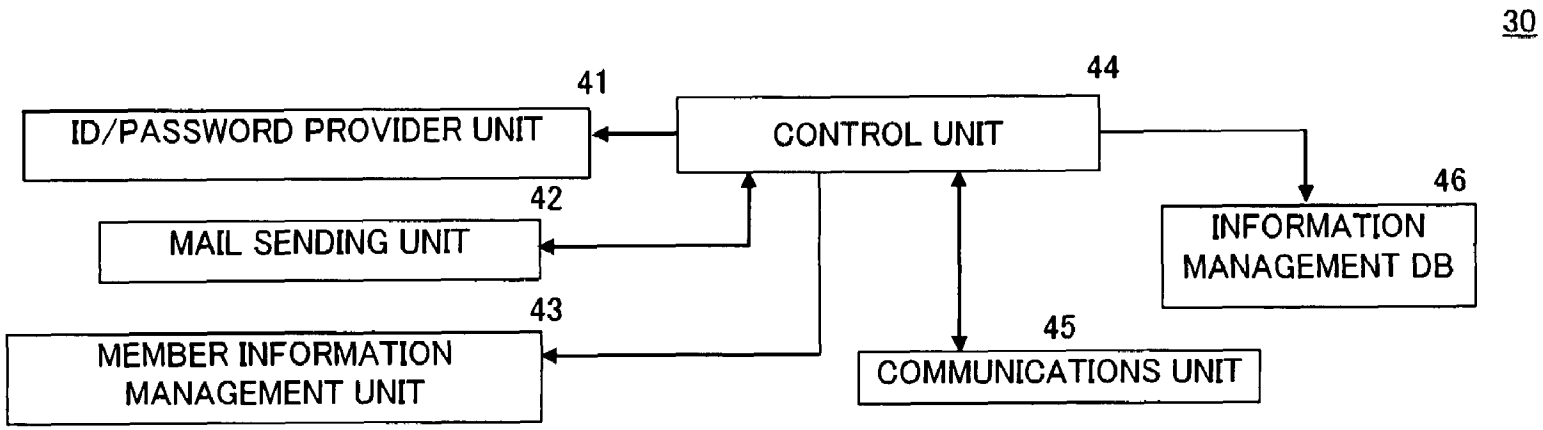
FIG. 6 is a schematic block diagram of an exemplary hardware configuration of an information management server according to the second embodiment of the present invention.

FIG. 6 is a block diagram of an exemplary configuration of the information management server 30. The information management server 30 includes a member information management unit 43 for storing contact information and payment information about the auction participants, an ID/password provider unit 41 for providing an auction participant with an ID and password, a mail sending unit 42 for sending the highest bidder an email indicating that the item has been won, a communications unit 45 for communicating data with the mobile data device 40, an information management database (DB) 46 for storing the item information about auction items and bid prices offered by the auction participants, and a control unit 44 to which all of the above-described units are connected. The control unit 44 performs overall control of the information management server 30.

The process in which an auction participant inputs the contact information and the information management server 30 provides the auction participant with an ID and password is now herein described.

First, the operation of the mobile data device 40 is described with reference to the accompanying drawings.

Figure 19:
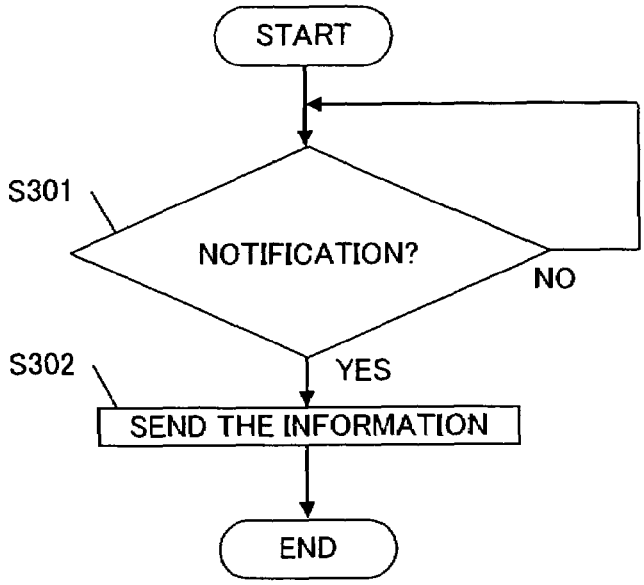
FIG. 19 is a flow chart of the operation of a communications unit.

The process of the communications unit 34 to send contact information about an auction participant is described next with reference to FIG. 19.

At step S301, the communications unit 34 determines whether it has received, from the control unit 35, a notification that an auction participant has input the user contact information and payment information via the operation unit 32. If the determination is affirmative (i.e., the notification of the input of contact information and payment information is present), the processing proceeds to step S302. However, if the determination is negative, the processing returns to step S301.

At step S302, the communications unit 34 sends the information, such as the contact information of the auction participant received from the control unit 35, to the communications unit 45 of the information management server 30. The processing is then completed.

The operation of the information management server 30 is described next with reference to the accompanying drawings.

Figure 20:
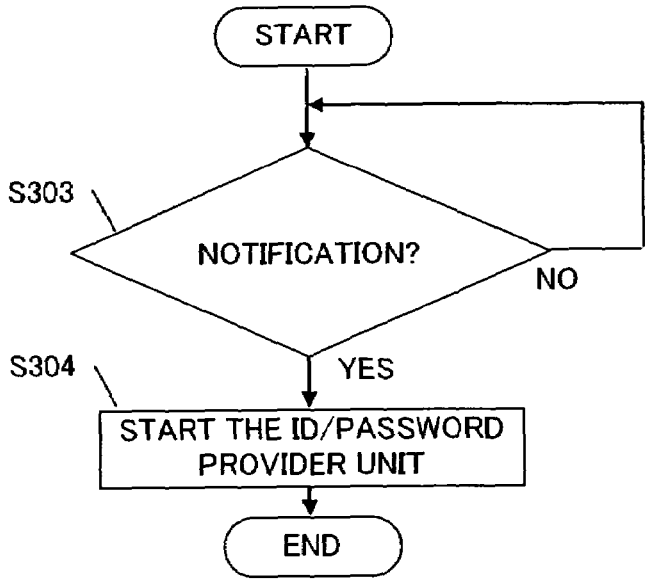
FIG. 20 is a flow chart of the operation of a control unit.

The process of the control unit 44 to start the ID/password provider unit 41 is described next with reference to FIG. 20.

At step S303, the control unit 44 determines whether it has received, from the communications unit 45, a notification that the communications unit 45 has received the contact information and payment information about the auction participant from the communications unit 34 of the mobile data device 40. If the determination is affirmative (i.e., the notification of the input of contact information and payment information is present), the processing proceeds to step S304. However, if the determination is negative, the processing returns to step S303.

At step S304, the control unit 44 starts the ID/password provider unit 41 so as to provide the auction participant with an ID and password. The ID and password are necessary for the auction participant to bid in an auction using the mobile data device 40. When the information management server 30 has authenticated the auction participant, the auction participant can register a bid price on the desired auction item to the information management server 30 using the mobile data device 40.

Figure 21:
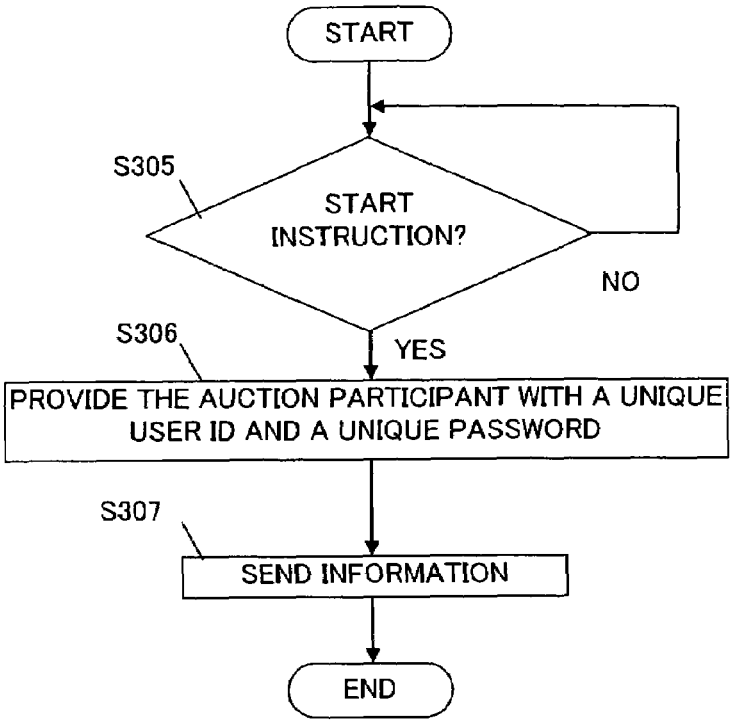
FIG. 21 is a flow chart of the operation of an ID/password provider unit.

The process of the ID/password provider unit 41 performed to provide an ID and password is described next with reference to FIG. 21.

At step S305, the ID/password provider unit 41 determines whether it has received a start instruction from the control unit 44. If the determination is affirmative (i.e., the start instruction is present), the processing proceeds to step S306. However, if the determination is negative, the processing returns to step S305.

At step S306, the ID/password provider unit 41 provides the auction participant with a unique user ID and a unique password. Thereafter, the processing proceeds to step S307.

At step S307, the ID/password provider unit 41 sends information about the issued user ID and password to the control unit 44. The processing is then completed.

Subsequently, the control unit 44 starts the communications unit 45 in order to send the issued user ID and password to the auction participant. The communications unit 45 sends the issued user ID and password to the mobile data device 40 so that the auction participant can receive his or her own user ID and password. Using these user ID and password, the auction participant can register a bid price for the auction item to the information management server 30.

The operation of the auction participant performed to read a two-dimensional code attached to the auction item and the process of the mobile data device 40 performed to retrieve the item information are described next.

The operation of the mobile data device 40 is described next with reference to the accompanying drawings.

Figure 22:
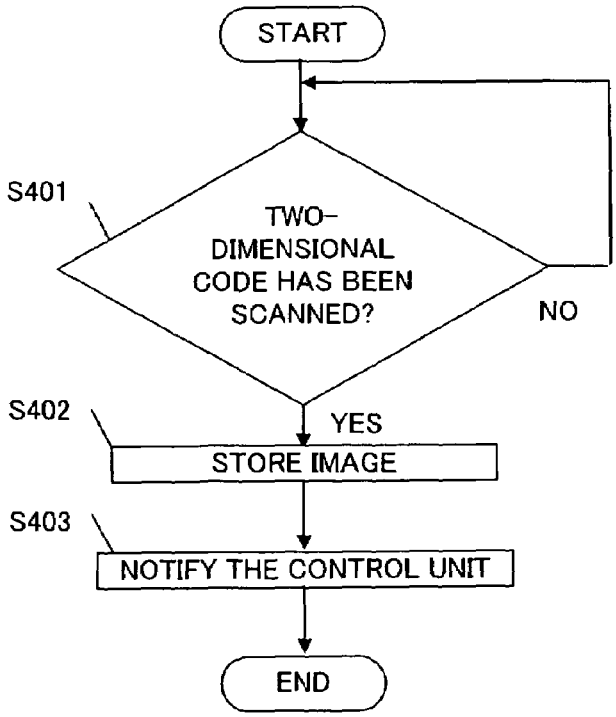
FIG. 22 is a flow chart of the operation of an information scanning unit.

The operation of the information scanning unit 36 performed to scan the two-dimensional code is described next with reference to FIG. 22.

At step S401, the information scanning unit 36 determines whether the two-dimensional code has been scanned by the auction participant. If the determination is affirmative (i.e., the two-dimensional code has been scanned), the processing proceeds to step S402. However, if the determination is negative, the processing returns to step S401.

At step S402, the information scanning unit 36 stores the image of the scanned two-dimensional code in the RAM 38. The processing then proceeds to step S403.

At step S403, the information scanning unit 36 notifies the control unit 35 of the completion of storing the scanned two-dimensional code. The processing is then completed.

Figure 23:
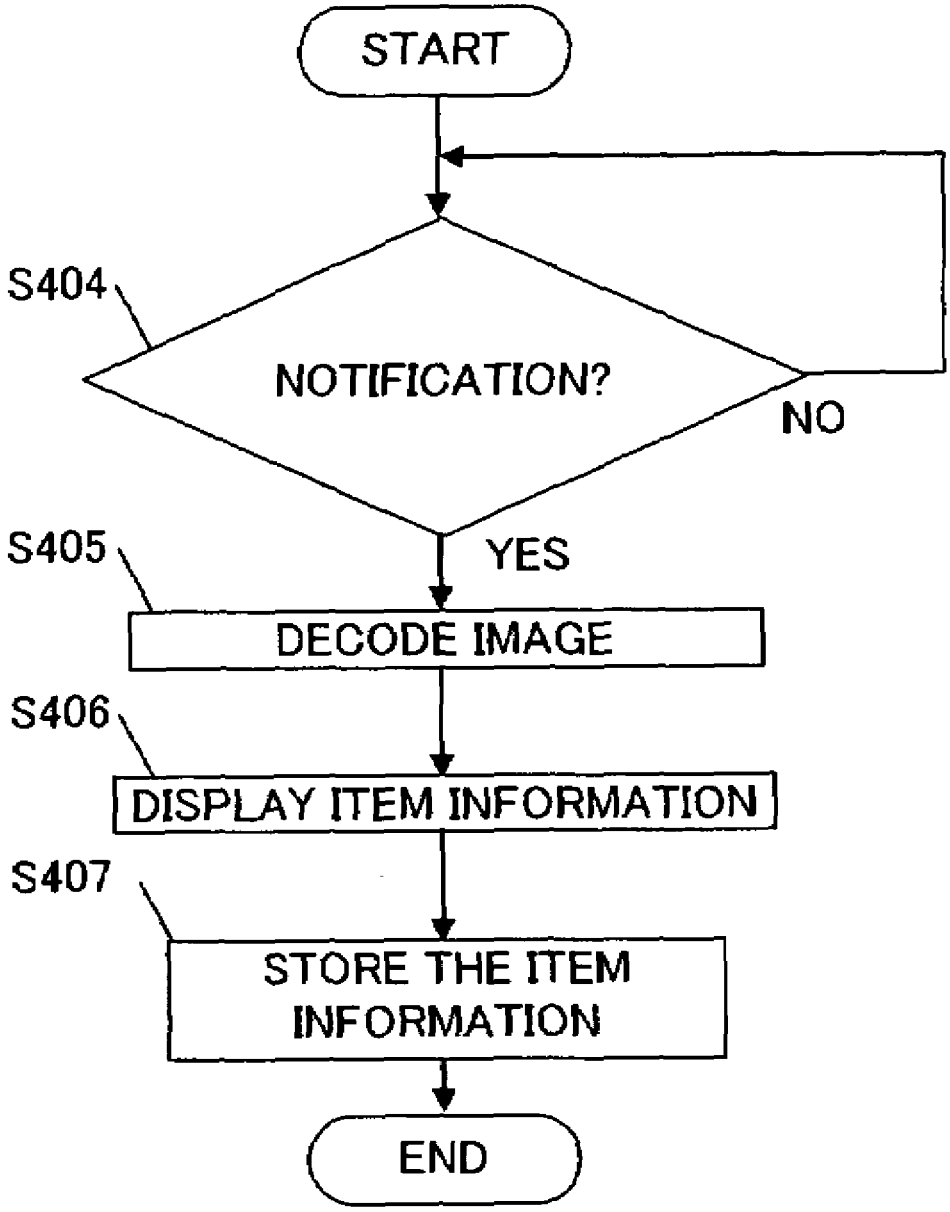
FIG. 23 is a flow chart of the operation of a control unit.

The process of the control unit 35 performed to decode the two-dimensional code is described next with reference to FIG. 23.

At step S404, the control unit 35 determines whether it has received a notification of the completion of storing the image from the information scanning unit 36. If the determination is affirmative (i.e., the notification of the completion of storing the image has been received), the processing proceeds to step S405. However, if the determination is negative, the processing returns to step S404.

At step S405, the control unit 35 decodes the image of the scanned two-dimensional code. To decode the scanned two-dimensional code, the control unit 35 loads a program for decoding a two-dimensional code from the storage unit 39 into the RAM 38 and runs the program. Thereafter, the processing proceeds to step S406.

At step S406, the control unit 35 displays item information obtained by decoding the two-dimensional code on the display unit 31. Thus, the auction participant can identify the item information (e.g., an item ID, the performance of the item, an auction starting time, and an auction ending time).

At step S407, the control unit 35 stores the item information in the storage unit 39. Thereafter, the processing is completed. Thus, the auction participant can immediately view the item information when the auction participant desires to view the item information and even when the auction participant is located far from the auction house.

The operation of the auction participant performed to check the highest bid price for the desired auction item using the mobile data device 40 is described next.

Figure 24:
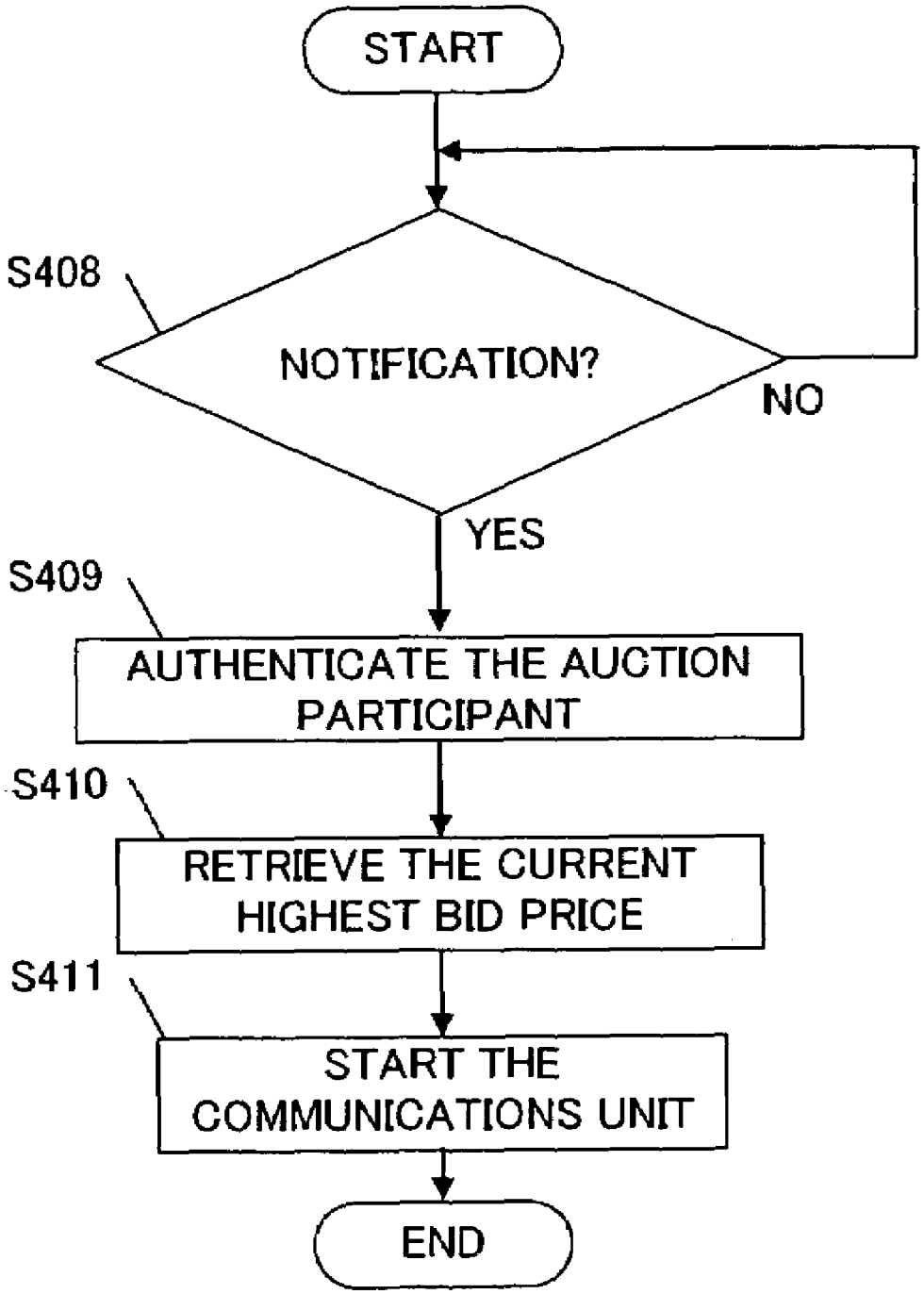
FIG. 24 is a flow chart of the operation of the control unit.

The process of the control unit 44 performed to check the highest bid price is described next with reference to FIG. 24.

At step S408, the control unit 44 determines whether it has received, from the communications unit 45, a notification that the communications unit 45 has received, from the communications unit 34 of the mobile data device 40, a notification that an auction participant has performed an item checking operation. If the determination is affirmative (i.e., the notification of the item checking operation is present), the processing proceeds to step S409. However, if the determination is negative, the processing returns to step S408. As used herein, the term "item checking operation" refers to an operation in which an auction participant inputs the user ID and password so as to check the current highest bid price for the auction item corresponding to the item ID.

At step S409, the control unit 44 authenticates the auction participant on the basis of the user ID and the password received from the communications unit 45. Thereafter, the processing proceeds to step S410.

At step S410, the control unit 44 references the item ID and retrieves the current highest bid price for the auction item corresponding to the item ID from the information management DB 46. The processing then proceeds to step S411.

At step S411, in order to notify the auction participant of the current highest bid price for the auction item retrieved at step S410, the control unit 44 starts the communications unit 45 and sends the current highest bid price to the communications unit 45. Thereafter, the processing is completed.

Subsequently, the current highest bid price is sent from the communications unit 45 to the mobile data device 40 so that the auction participant can receive the current highest bid price for the desired auction item. The auction participant then places a bid on the auction item as needed.

The operation of the auction participant performed to place a bid on the desired auction item is described next.

The process of the information management server 30 is described next with reference to the accompanying drawings.

Figure 25:
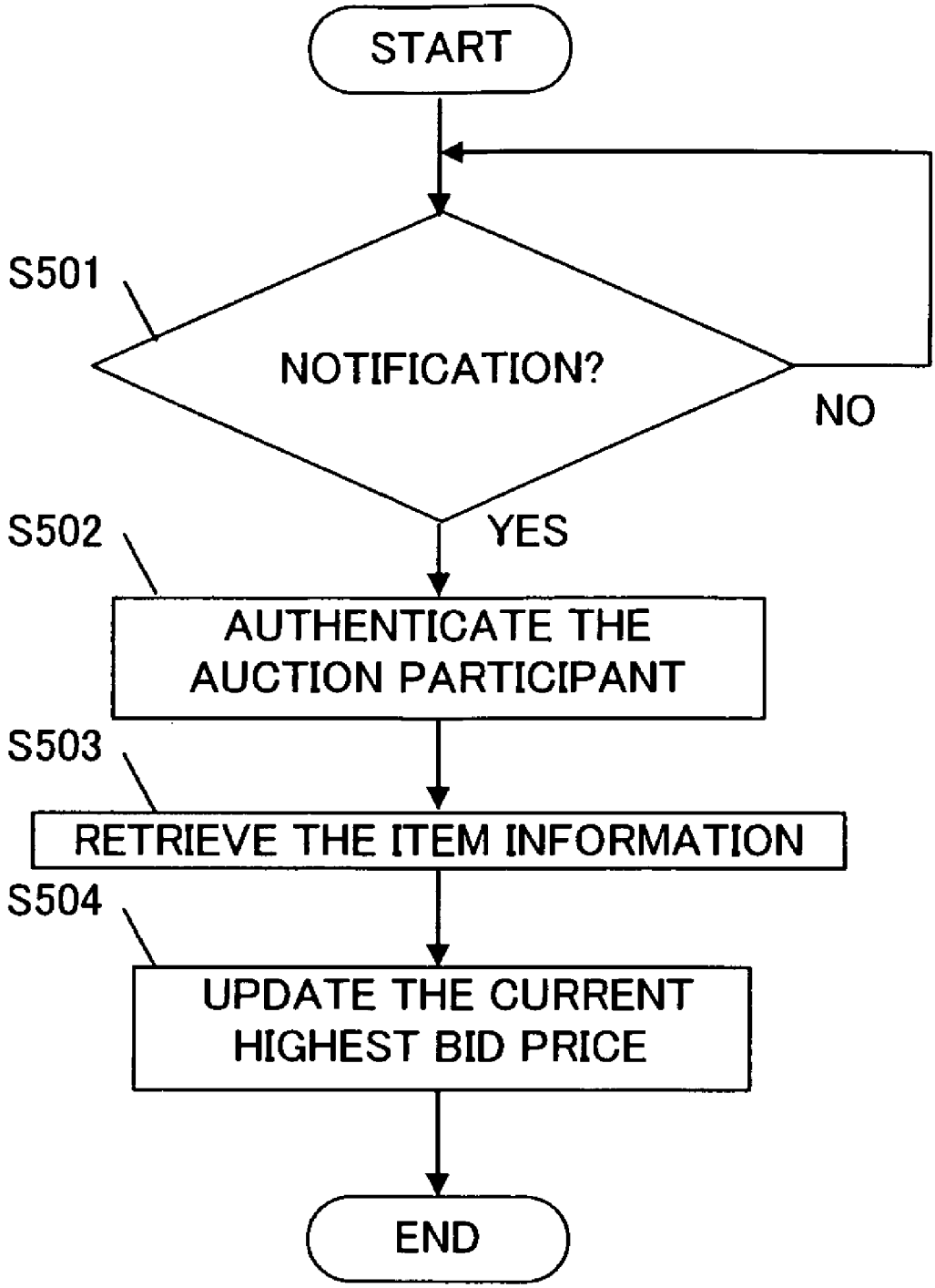
FIG. 25 is a flow chart of the operation of the control unit.

The operation of the control unit 44 performed to update the highest bid price is described next with reference to FIG. 25.

At step S501, the control unit 44 determines whether it has received, from the communications unit 45, a notification that the communications unit 45 has received, from the communications unit 34 of the mobile data device 40, a notification that an auction participant has performed a bid operation. If the determination is affirmative (i.e., the notification of the bid operation is present), the processing proceeds to step S502. However, if the determination is negative, the processing returns to step S501. As used herein, the term "bid operation" refers to an operation in which an auction participant inputs the user ID and password, the item ID, and the bid price so as to update the current highest bid price for the auction item.

At step S502, the control unit 44 authenticates the auction participant on the basis of the user ID and the password received from the communications unit 45. Thereafter, the processing proceeds to step S503.

At step S503, in order to update the current highest bid price, the control unit 44 references the item ID and retrieves the item information corresponding to the item ID from the information management DB 46. The processing then proceeds to step S504.

At step S504, the control unit 44 updates the current highest bid price in the item information received at step S503. Thereafter, the processing is completed.

The process of the information management server 30 performed to notify the auction participant of the information that the auction participant has won the bid on the auction item is described next with reference to the accompanying drawings.

Figure 26:
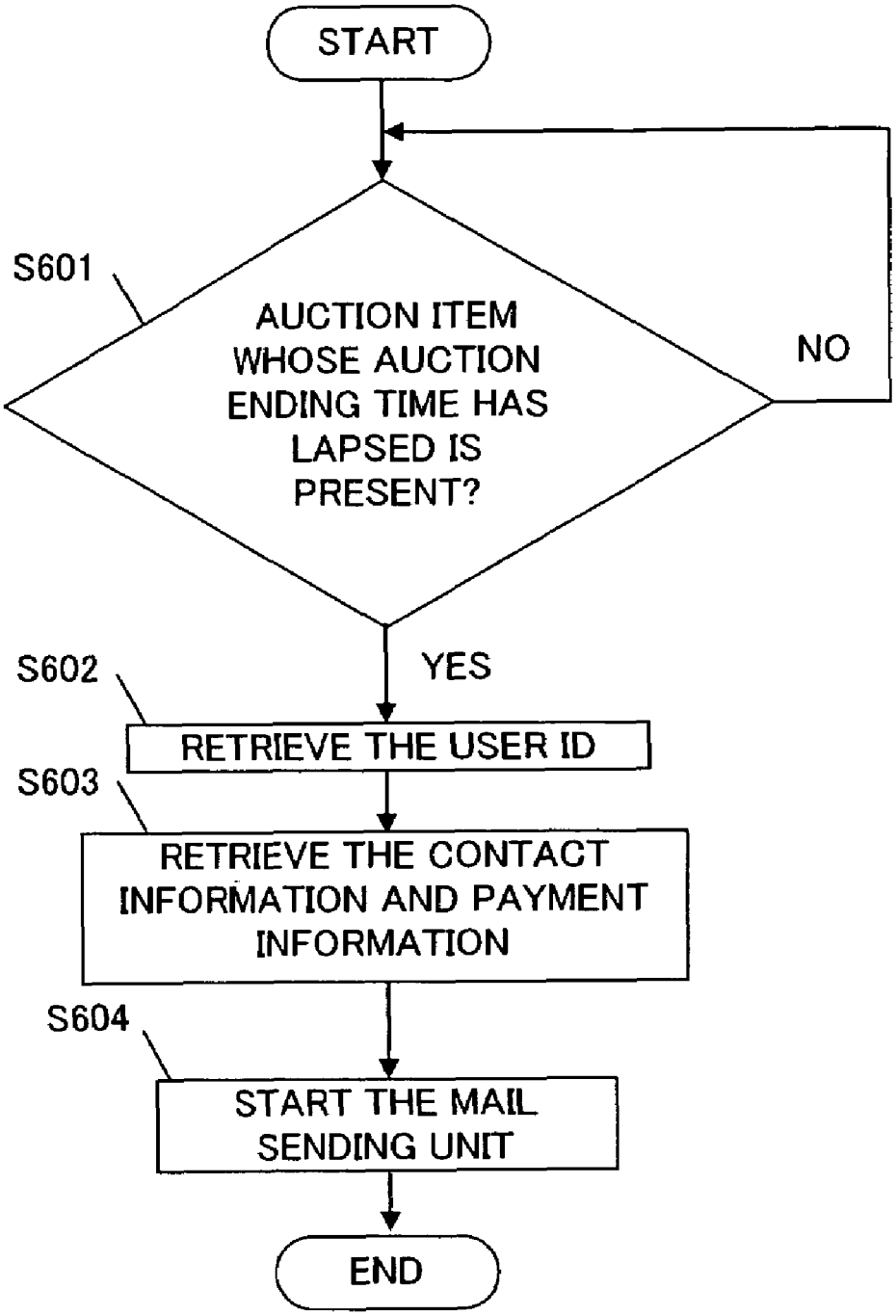
FIG. 26 is a flow chart of the operation of the control unit.

The operation of the control unit 44 performed to start the mail sending unit 42 is described next with reference to FIG. 26.

The control unit 44 monitors the auction ending time in the item information stored in the information management DB 46. At step S601, the control unit 44 determines whether an auction item whose auction ending time has lapsed is present in the item information stored in the information management DB 46. If the determination is affirmative (i.e., an auction item whose auction ending time has lapsed is present), the processing proceeds to step S602. However, if the determination is negative, the processing returns to step S601.

At step S602, the control unit 44 retrieves the user ID of the auction participant who has offered the highest bid price for the auction item whose auction ending time has lapsed. The processing then proceeds to step S603.

At step S603, the control unit 44 references the user ID retrieved at step S602 and retrieves the contact information and payment information of the auction participant who has won the bid on the item from the member information management unit 43. The processing then proceeds to step S604.

At step S604, the control unit 44 starts the mail sending unit 42 and notifies the mail sending unit 42 of the contact information and the payment information of the auction participant who has won the bid on the item, and the item ID and the purchase price of the auction item that the auction participant has won the bid on. Thereafter, the processing is completed.

Figure 27:
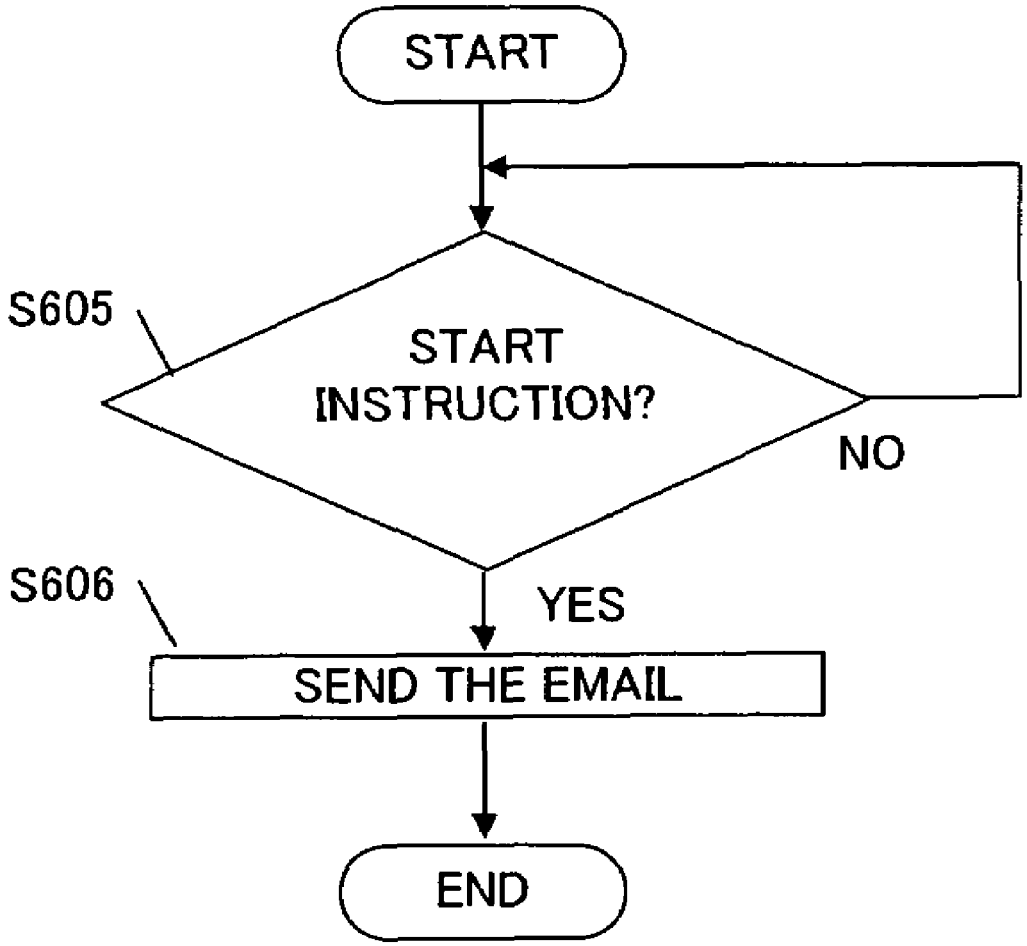
FIG. 27 is a flow chart of the operation of a mail sending unit.

The process of the mail sending unit 42 performed to send an email to the auction participant who has won the bid on the item is described next with reference to FIG. 27.

At step S605, the mail sending unit 42 determines whether it has received a start instruction from the control unit 44. If the determination is affirmative (i.e., the start instruction has been received), the processing proceeds to step S606. However, if the determination is negative, the processing returns to step S605.

At step S606, the mail sending unit 42 references the contact information received from the control unit 44 and sends an email to the auction participant who has won the bid on the auction item. The email contains the item ID and a purchase price of the item that the auction participant has won the bid on. Thus, the auction participant can confirm that the auction participant has won the bid on the auction item. Thereafter, the processing is completed.

Although the invention has been shown and described with reference to the foregoing embodiments, alternative embodiments may be made without departing from the spirit and scope of the invention as defined in following claims.

What is claimed is:

1. An auction system for determining a bid price for an auction item, comprising:

a recording medium for storing item information about the auction item and a bid price of the auction item, the item information being rewritable, the recording medium attached to the auction item;

a mobile data device including first readout means for reading out the item information from the recording medium and bidding means for writing a bid price of the auction item into the recording medium; and an information management apparatus including storing means, winner determining means and second readout means, the second readout means reading out the item information and the bid price of the auction item from the recording medium, the storing means storing the current most appropriate bid price in an auction rule read out from the recording medium, information for identifying a bidder who has written the most appropriate bid price into the recording medium, information for identifying the auction item having the most appropriate bid price, and information about a condition for closing the auction on the auction item, the winner determining means determining a winning bidder for the auction item on the basis of the most appropriate bid price when the condition for closing the auction on the auction item is satisfied.

2. An auction system for determining a bid price for an auction item, comprising:

a recording medium for storing item information about the auction item, a bid price of the auction item, the item information being rewritable, the recording medium attached to the auction item;

a mobile data device including first readout means for reading out the item information from the recording medium and writing means for writing a bid price of the auction item into the recording medium; and an information management apparatus including second readout means, storing means, and winner determining means, the second readout means reading out the item information and the bid price of the auction item, the storing means storing the current most appropriate bid price in an auction rule read out by the second readout means, information for identifying a bidder who has written the most appropriate bid price into the recording medium, and information for identifying an auction item having the most appropriate bid price, the winner determining means determining a winning bidder for the auction item on the basis of the most appropriate bid price when an ending time of the auction on the auction item has been reached.

3. The auction system according to claim 1, further comprising:

a notification unit;

wherein the information about a condition for closing the auction on the auction item is information about an ending time of the auction on the auction item and the notification unit notifies the bidder who has written the highest bid price into the recording medium of information that the bidder has won the auction item when an ending time of the auction on the auction item has been reached.

4. The auction system according to claim 1, further comprising:

a notification unit;

wherein the information about a condition for closing the auction on the auction item is information about a bid price and the notification unit notifies a bidder who has written a bid price into the recording medium, the bid price being equal to a price that a seller of the auction item desires of information that the bidder has won the auction item.

5. The auction system according to claim 1, further comprising:

bid ending time monitoring means;

wherein the information about a condition for closing the auction on the auction item is information about an ending time of the auction on the auction item, and the bid ending time monitoring means notifies information management apparatus that the ending time of the auction has been reached.

6. The auction system according to claim 1, wherein the information about a condition for closing the auction on the auction item is information about an ending time of the auction on the auction item, and a third party notifies information management apparatus that the ending time of the auction has been reached.

7. The auction system according to claim 2, wherein the recording medium includes an IC tag.

8. The auction system according to claim 1, wherein the recording medium includes a two-dimensional code.

9. The auction system according to claim 1, wherein the mobile data device includes a mobile RFTD reader/writer.

10. The auction system according to claim 1, wherein the mobile data device includes a cell phone.

11. An auction system for determining a bid price for an auction item, comprising:

a recording medium for storing item information about the auction item and a bid price of the auction item, the recording medium being attached to the auction item, the item information being rewritable, the recording medium attached to the auction item;

a mobile data device including first readout unit for reading out the item information from the recording medium and bidding unit for writing a bid price of the auction item into the recording medium; and an information management apparatus including storing unit and winner determining unit and second readout unit, the second readout unit reading out the item information and the bid price of the auction item from the recording medium, the storing unit storing the current most appropriate bid price in an auction rule read out from the recording medium, information for identifying a bidder who has written the most appropriate bid price into the recording medium, information for identifying the auction item having the most appropriate bid price, and information about a condition for closing the auction on the auction item, the winner determining unit determining a winning bidder for the auction item on the basis of the most appropriate bid price when the condition for closing the auction on the auction item is satisfied.

* * * * *